US007885562B2

(12) United States Patent
Wang et al.

(10) Patent No.: US 7,885,562 B2
(45) Date of Patent: Feb. 8, 2011

(54) COLOR IMAGE FORMING APPARATUS HAVING MOVABLE DEVELOPER MEMBERS

(75) Inventors: Wei Ming Wang, Nagoya (JP); Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 12/362,509

(22) Filed: Jan. 30, 2009

(65) Prior Publication Data

US 2009/0190958 A1 Jul. 30, 2009

(30) Foreign Application Priority Data

Jan. 30, 2008 (JP) ..... 2008-019568

(51) Int. Cl.
*G03G 15/01* (2006.01)

(52) U.S. Cl. ..... 399/54; 399/228

(58) Field of Classification Search ..... 399/54, 399/112, 223, 228, 298, 299; 347/115
See application file for complete search history.

(56) References Cited

U.S. PATENT DOCUMENTS 6,795,671 B2 9/2004 Matsuoka
6,859,635 B2 * 2/2005 Yabuki et al. ..... 399/299
7,555,245 B2 * 6/2009 Kamimura ..... 399/228
7,561,827 B2 * 7/2009 Shiraki et al. ..... 399/119
7,599,651 B2 * 10/2009 Kitagawa et al. ..... 399/302
7,643,770 B2 * 1/2010 Sato et al. ..... 399/90
7,680,436 B2 * 3/2010 Hayakawa ..... 399/119
7,689,139 B2 * 3/2010 Kamimura ..... 399/90
7,693,443 B2 * 4/2010 Sato et al. ..... 399/90
7,715,755 B2 * 5/2010 Shiraki ..... 399/111
7,715,756 B2 * 5/2010 Hattori ..... 399/119
7,787,805 B2 * 8/2010 Kamimura ..... 399/228
2003/0223785 A1 * 12/2003 Kanekura et al. ..... 399/299
2007/0077093 A1 4/2007 Okabe et al.
2007/0134028 A1 * 6/2007 Funabashi ..... 399/299
2007/0147888 A1 * 6/2007 Igarashi et al. ..... 399/119
2007/0147889 A1 * 6/2007 Kamimura ..... 399/119
2007/0280730 A1 * 12/2007 Okabe et al. ..... 399/111
2008/0240778 A1 * 10/2008 Ishikawa et al. ..... 399/119
2009/0169247 A1 * 7/2009 Hattori ..... 399/111

(Continued)

FOREIGN PATENT DOCUMENTS

JP 60069670 A * 4/1985

(Continued)

*Primary Examiner*—Robert Beatty
(74) *Attorney, Agent, or Firm*—Banner & Witcoff, Ltd.

(57) ABSTRACT

An image forming apparatus is provided. The image forming apparatus includes an apparatus main body; a plurality of image carrying members; a plurality of developing members; a translation member that reciprocates in a straight line in a direction in which the image carrying members are aligned to move the developing members between an engagement position where the developing members are brought into contact with the image carrying members and a disengagement position where the developing members are disengaged from the image carrying members; and a force imparting mechanism, when at least one of the developing members is moved from the disengagement position to the engagement position by a movement of the translation member in a first direction, the force imparting mechanism imparting a force that includes a force component directed to a second direction opposite to the first direction into the translation member.

8 Claims, 13 Drawing Sheets

U.S. PATENT DOCUMENTS

2009/0169253 A1* 7/2009 Kamimura et al. ..... 399/117
2009/0175652 A1* 7/2009 Kamimura ..... 399/113
2009/0175653 A1* 7/2009 Kamimura ..... 399/117
2009/0220275 A1* 9/2009 Hashimoto ..... 399/116
2009/0269097 A1* 10/2009 Hashimoto ..... 399/90
2009/0304412 A1* 12/2009 Hattori et al. ..... 399/111

FOREIGN PATENT DOCUMENTS

JP 2002139887 A * 5/2002
JP 2003-215876 7/2003
JP 2007-101636 4/2007

* cited by examiner

COLOR IMAGE FORMING APPARATUS HAVING MOVABLE DEVELOPER MEMBERS

CROSS REFERENCE TO RELATED APPLICATION

The present application claims priority from Japanese Patent Application No. 2008-019568, which was filed on Jan. 30, 2008, the disclosure of which is herein incorporated by reference in its entirety.

TECHNICAL FIELD

Apparatuses and devices consistent with the present invention relate to an image forming apparatus such as an electrophotographic printer.

BACKGROUND

Japanese unexamined patent application publication No. JP-A-2007-101636 describes a related art image forming apparatus. In the related image forming apparatus such as an electrophotographic printer, there are known so-called tandem type color printer in which photosensitive drums corresponding respectively to colors such as yellow, magenta, cyan and black are disposed in parallel.

In this tandem type color printer or image forming apparatus, developing rollers are provided so as to correspond respectively to the photosensitive drums. By the photosensitive drums and the developing rollers being driven to rotate in such a state that the developing drums are in engagement with the photosensitive drums, toner is supplied to latent images formed on the photosensitive drums from the developing rollers, whereby toner images are held on the photosensitive drums. The toner images corresponding to the colors of the photosensitive drums are formed on the photosensitive drums, and the toner images in the respective colors are transferred onto a sheet in a superimposed fashion color by color, whereby the formation of a full color image on the sheet is achieved. In addition, a black toner image is formed only on the photosensitive drum corresponding to black, and by the black toner image being transferred onto a sheet, the formation of a monochrome image on the sheet is achieved.

Since no toner image is formed on the other yellow, magenta and cyan photosensitive drums than the black photosensitive drum when a monochrome image is formed, the corresponding developing rollers are desirably disengaged or spaced apart from the yellow, magenta and cyan photosensitive drums so as to prevent the wear of the developing rollers.

Then, as such a tandem type image forming apparatus, there is proposed an image forming apparatus including engagement and disengagement members which can move in a straight line in a direction in which photosensitive drums are arranged, so as to switch the position of corresponding developing rollers to an all color photosensitive drums disengagement state in which the developing rollers are disengaged or spaced apart from all the photosensitive drums, a black photosensitive drum disengagement state in which the developing roller is left in engagement with the black photosensitive drum, while the other developing rollers are disengaged or spaced apart from the yellow, magenta and cyan photosensitive drums, and an all color photosensitive drums engagement state in which the developing rollers are in engagement with all the photosensitive drums.

The engagement and disengagement members extend in the direction in which the photosensitive drums are arranged and each have a flat upper surface. Cam portions having a trapezoidal shape as viewed from the side are formed on the upper surface of the engagement and disengagement members. The cam portions each have a sliding surface which is inclined from the upper surface of the engagement and disengagement member obliquely upwards towards a predetermined direction which follows along the direction in which the photosensitive drums are arranged (referred simply to as a "predetermined direction" in this section and the following section entitled "Summary") and a flat spacing surface which extends from an end of the sliding surface in the predetermined direction in parallel with the upper surface of the engagement and disengagement member. In addition, projecting portions are formed on a developing cartridge so as to project from an upper end portion thereof in a direction which intersects the predetermined direction at right angles. The projecting portions confront the corresponding engagement and disengagement members from thereabove.

In such a state that the projecting portions are placed on contact planes constituted by the upper surfaces of the engagement and disengagement members, the developing rollers are disposed in an engagement position where the developing rollers are in engagement with the corresponding photosensitive drums. When the engagement and disengagement members are caused to move in an opposite direction to the predetermined direction from the state described above, the projecting portions move from the contact planes to the sliding surfaces of the cam portions, slide over the sliding surfaces and thereafter ride onto the spacing surfaces of the cam portions. By this series of actions, the developing cartridges are raised by the projecting portions, and the developing rollers are disposed in a disengagement portion where the developing rollers are disengaged or spaced apart from the corresponding photosensitive drums. On the other hand, when the engagement and disengagement members are caused to move in the predetermined direction from this state, the projecting portions move from the spacing surfaces to the sliding surfaces, slide over the sliding surfaces and are allowed to return to the contact planes. By this series of actions, the developing cartridges move downwards, whereby the developing rollers are disposed in the engagement position where the developing rollers are brought into contact with the corresponding photosensitive drums.

SUMMARY

When the engagement and disengagement members are caused to move in the predetermined direction and the projecting portions move from the spacing surfaces to the sliding surface, a force vertical to the sliding surface is applied to the sliding surfaces by the projecting portions. A force component directed in the predetermined direction is included in this force. Because of this, when the developing cartridges are caused to move from the disengagement position to the engagement position, the movement of the engagement and disengagement members in the predetermined direction is pressed by the force applied from the projecting portions to the sliding surfaces. As a result, there may be caused a fear that impact noise is generated due to an undesirable collision between the engagement and disengagement members with the other members (for example, pinion gears which mesh with rack gears formed on the engagement and disengagement members).

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus which can prevent the movement of translation members in the predetermined direction from being pressed when developing members are caused to move from a disengagement position to an engagement position.

According to an aspect of the invention, there is provided an image forming apparatus comprising: an apparatus main body; a plurality of image carrying members disposed in parallel in the apparatus main body; a plurality of developing members for developing latent images formed on the image carrying members, each developing member being associated with a respective image carrying member; a translation member that reciprocates in a straight line in a direction in which the image carrying members are aligned to move the developing members between an engagement position where the developing members are brought into contact with the image carrying members and a disengagement position where the developing members are disengaged from the image carrying members; and a force imparting mechanism, when at least one of the developing members is moved from the disengagement position to the engagement position by a movement of the translation member in a first direction, the force imparting mechanism being brought into abutment with the translation member in motion, and imparting a force that includes a force component directed to a second direction opposite to the first direction into the translation member.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

1. Overall Configuration of Printer

Figure 1:
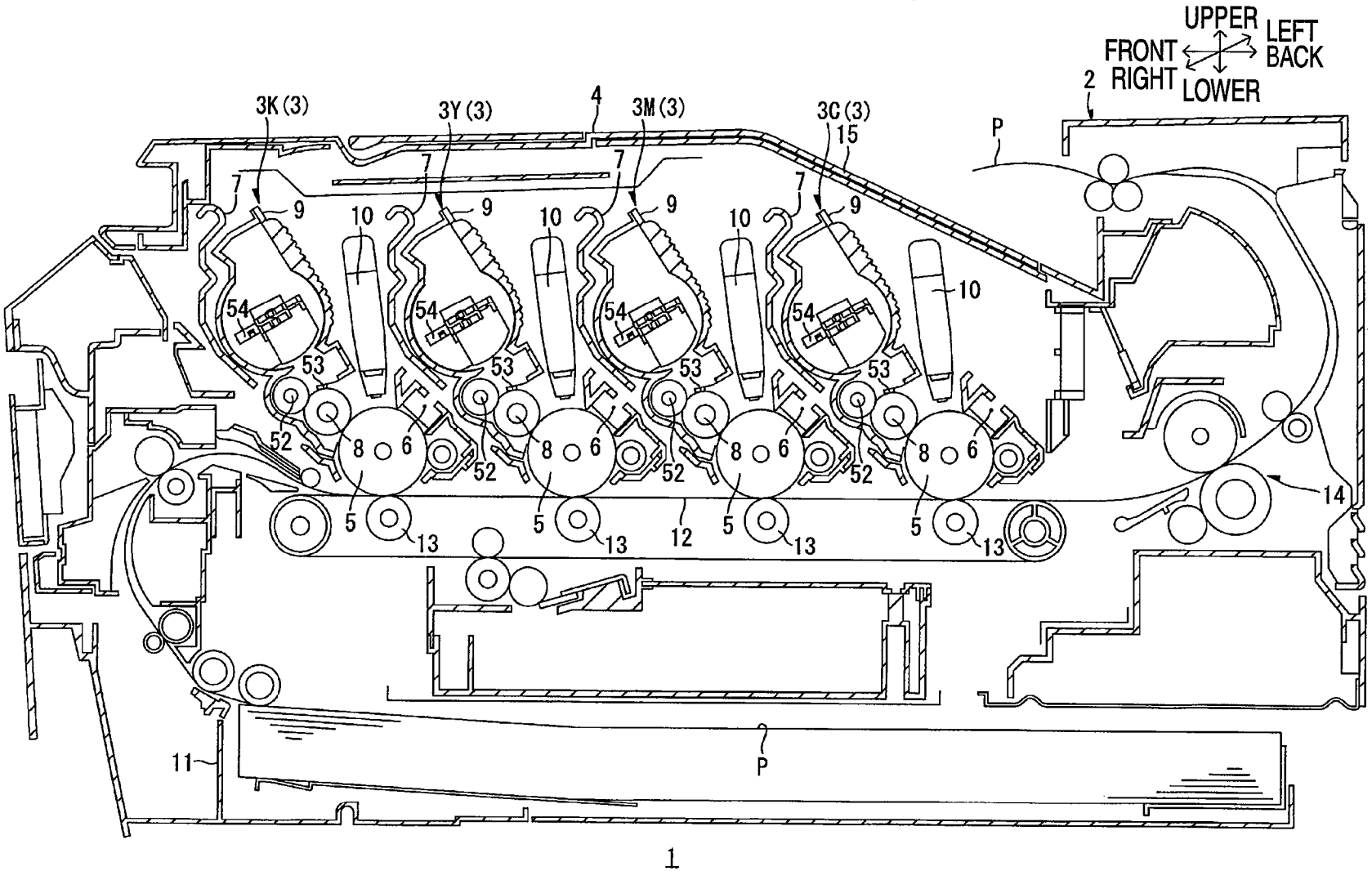
FIG. 1 is a sectional side view showing an exemplary embodiment of a printer as an example of an image forming apparatus of the present invention.

FIG. 1 is a side sectional view showing an exemplary embodiment of a printer as an example of an image forming apparatus of the invention.

A printer 1 is a tandem type color printer. Four process cartridges 3 are disposed in parallel so as to correspond to respective colors of black, yellow, magenta and cyan in an interior of a main casing 2 as an example of an apparatus main body. The respective process cartridges 3 can be mounted in and dismounted from the interior of the main casing 2 with a top cover 4 opened which is mounted on an upper surface of the main casing 2.

Each process cartridge 3 includes a drum cartridge 7 which holds a photosensitive drum 5 and a scorotron-type charger 6 and a developing cartridge which holds a developing roller 8 and which is detachably attached to the drum cartridge 7. A surface of each photosensitive drum 5 is uniformly charged by the corresponding scorotron-type charger 6 and is thereafter selectively exposed by LEDs provided on a corresponding LED unit 10. By this configuration, a latent image based on image data of an original image is formed on the surface of the photosensitive drum 5. Each latent image is visualized by toner carried by the developing roller 8, whereby a toner image is formed on the surface of the photosensitive drum 5.

Sheets P are stored in a sheet feeding cassette 11 which is disposed in a bottom part of the main casing 2. Sheets P stored in the sheet feeding cassette are conveyed onto a conveyer belt 12 by various types of rollers. The conveyor belt 12 is disposed so as to confront the four photosensitive drums 5 from therebelow. A sheet P that has been conveyed onto the conveyor belt 12 passes sequentially the respective photosensitive drums 5 while being conveyed between the conveyor belt 12 and the photosensitive drums 5 by the conveyor belt 12 running. In addition, the toner images formed on the surfaces of the photosensitive drums 5 are transferred onto the sheet P by transfer bias applied to transfer rollers 13 when the sheet P confronts the photosensitive drums 5. The transfer rollers 13 are disposed so as to confront the corresponding photosensitive drums 5 across the conveyor belt 12.

The sheet P onto which the toner images have been transferred is conveyed to a fixing unit 14. The toner images transferred onto the sheet P are thermally fused or fixed in the fixing unit 14. Thereafter, the sheet P is discharged onto a sheet discharging tray 15 by various types of rollers.

In addition, when attempting to distinguish a specific process cartridge 3 from the other process cartridges 3 in terms of color, characters denoting the respective colors such as K (black), Y (yellow), M (magenta) and C (cyan) are given to the respective reference numerals at the ends thereof.

Additionally, an upstream side of a conveying direction of sheets P by the conveyor belt 12 is referred to as a front side of the printer 1, based on which left and right sides of the printer 1 when the printer 1 is viewed from the front side are determined. As to the process cartridges 3, in such a state that they are placed horizontally, a side where the developing cartridge 9 is disposed is referred to as a front side relative to the photosensitive drum 5, based on which top, bottom, left and right of the process cartridge 3 when it is viewed from the front side may be determined from time to time. Arrows indicating directions such as front, back or rear, top or upper, bottom or lower, left and right of the printer and its constituent components are shown in the respective drawings showing them.

2. Process Cartridge

Figure 2:
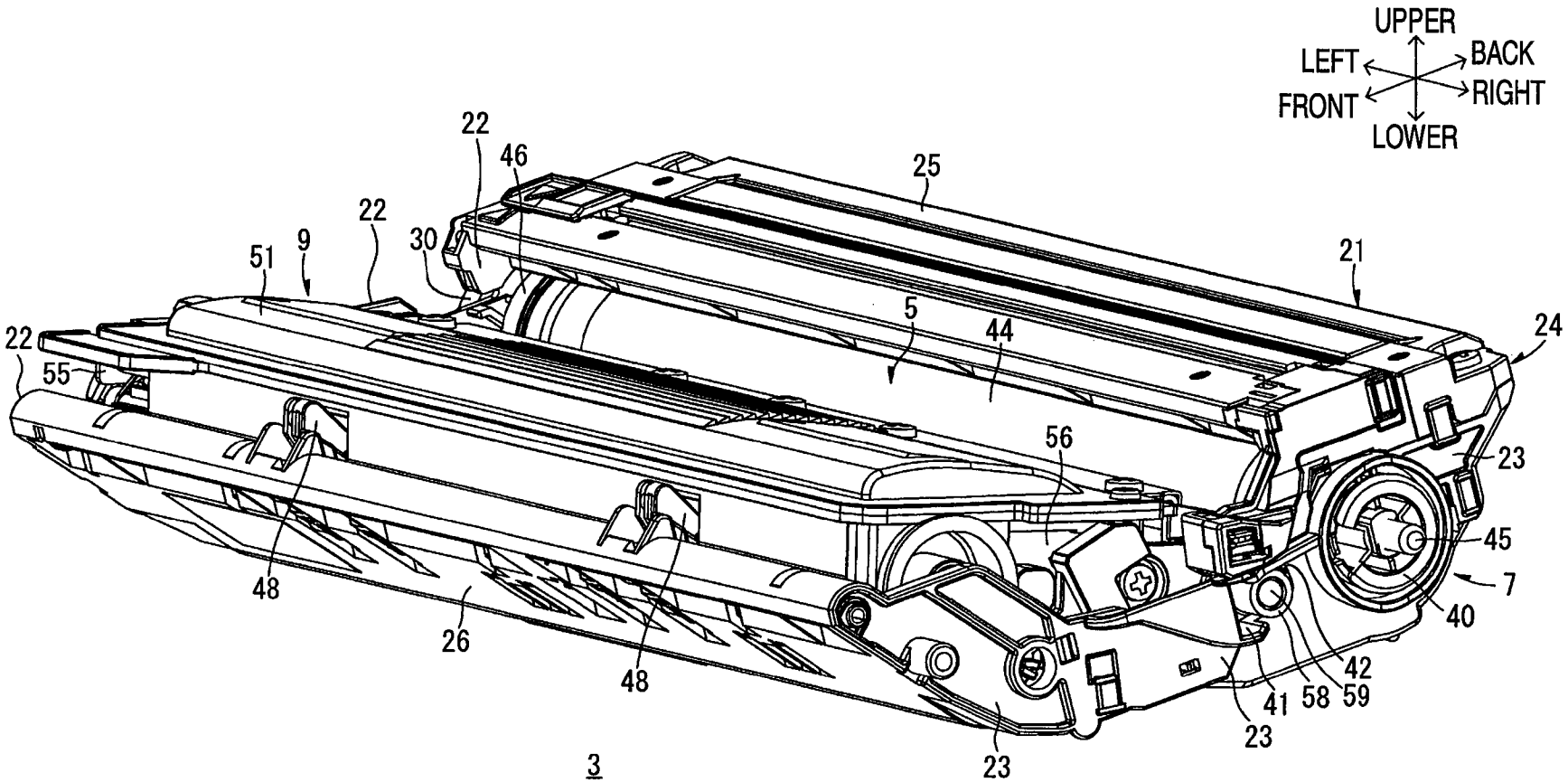
FIG. 2 is a perspective view of a process cartridge as viewed from a front right direction.

FIG. 2 is a perspective view of the process cartridge as viewed from a front right direction.

(1) Drum Cartridge

The drum cartridge 7 includes a drum frame 21. The drum frame 22 has integrally a pair of drum side walls 22, 23, a drum rear wall 24, a drum top wall 25, and a drum front wall 26.

The pair of drum side walls 22, 23 are disposed in a left-right or transverse direction so as to confront each other at a predetermined interval provided therebetween. The photosensitive drum 5 is held rotatably between respective rear end portions of the drum side walls 22, 23. In addition, in the respective drum side walls 22, 23, mounting guide grooves 42 are formed in a position lying further forwards than the rear end portions where the photosensitive drum 5 is held by cutting out partially the side walls into a configuration whose external shape has a substantially U-shape with its open end directed rearwards as viewed from the side. Additionally, a cylindrical protecting portion 30 is formed at the rear end portion of the left-hand drum side wall 22 so as to surround the periphery of a left end portion of the photosensitive drum 5.

The drum rear wall 24 is provided so as to extend between respective rear ends of the drum side walls 22, 23.

The drum top wall 25 is provided so as to extend between upper ends of the respective rear end portions of the drum side walls 22, 23.

The drum front wall 26 is provided so as to extend between front ends of the drum side walls 22, 23 and is formed so as to be inclined obliquely upwards as it extends forwards. Pressing levers 48 are provided on the drum front wall 26 in two locations which lie to confront each other in the transverse direction across a center portion thereof for pressing the developing cartridge 9 towards the photosensitive drum 5.

(2) Developing Cartridge

As shown in FIG. 2, the developing cartridge 9 is disposed in a space defined by the drum side walls 22, 23 and the drum front wall 26 in such a state that the developing cartridge 9 is attached to the drum cartridge 7.

The developing cartridge 9 includes a housing 51. The housing 51 has a box shape which is opened at its back side. As shown in FIG. 1, the developing roller 8, a supply roller 52, a layer thickness regulating blade 53 and an agitator 54 are held in the housing 51.

The developing roller 8 is disposed so as to be exposed to the rear from the housing 51 and is supported rotatably on both side walls 55, 56 of the housing 51. Substantially cylindrical developing bearing members 58 (a left-hand developing bearing member 58 is not shown) are provided at respective rear end portions of the side walls 55, 56 so as to project outwards. The developing bearing members 58 are disposed in positions which confront each other in the transverse direction. The developing roller 8 has a configuration in which a metallic developing roller shaft 59 is covered with a rubber roller made of a conductive rubber. In addition, the developing roller 8 is rotatably supported on the side walls 55, 56 by both end portions of the developing roller shaft 59 being rotatably inserted into the developing bearing members 58.

(3) Attachment of Developing Cartridge to Drum Cartridge

The developing cartridge 9 is attached to the drum cartridge 7 from the front of the photosensitive drum 5. In attaching the developing cartridge 9 to the drum cartridge 7 in this way, firstly, the developing bearing members 58 which projects from the left and right sides of the housing 51 of the developing cartridge 9 are fitted in the corresponding mounting guide grooves 42, respectively. Then, by the developing cartridge 9 being pushed rearwards, the developing cartridge 9 moves rearwards while the developing bearing members 58 are being guided rearwards by the corresponding mount guiding grooves 42, respectively. During the movement of the developing cartridge 9 in this way, the housing 51 of the developing cartridge 9 are brought into abutment with the pressing levers 48, and by the housing 51 being pushed downwards against the pressure of the pressing levers 48, the attachment of the developing cartridge 9 to the drum cartridge 7 is completed. In this state, in the developing cartridge 9, the developing roller 8 is brought into press contact with the photosensitive drum 5 by virtue of the pressure (the pressing force) of the pressing levers 48.

3. Body Frame

Figure 3:
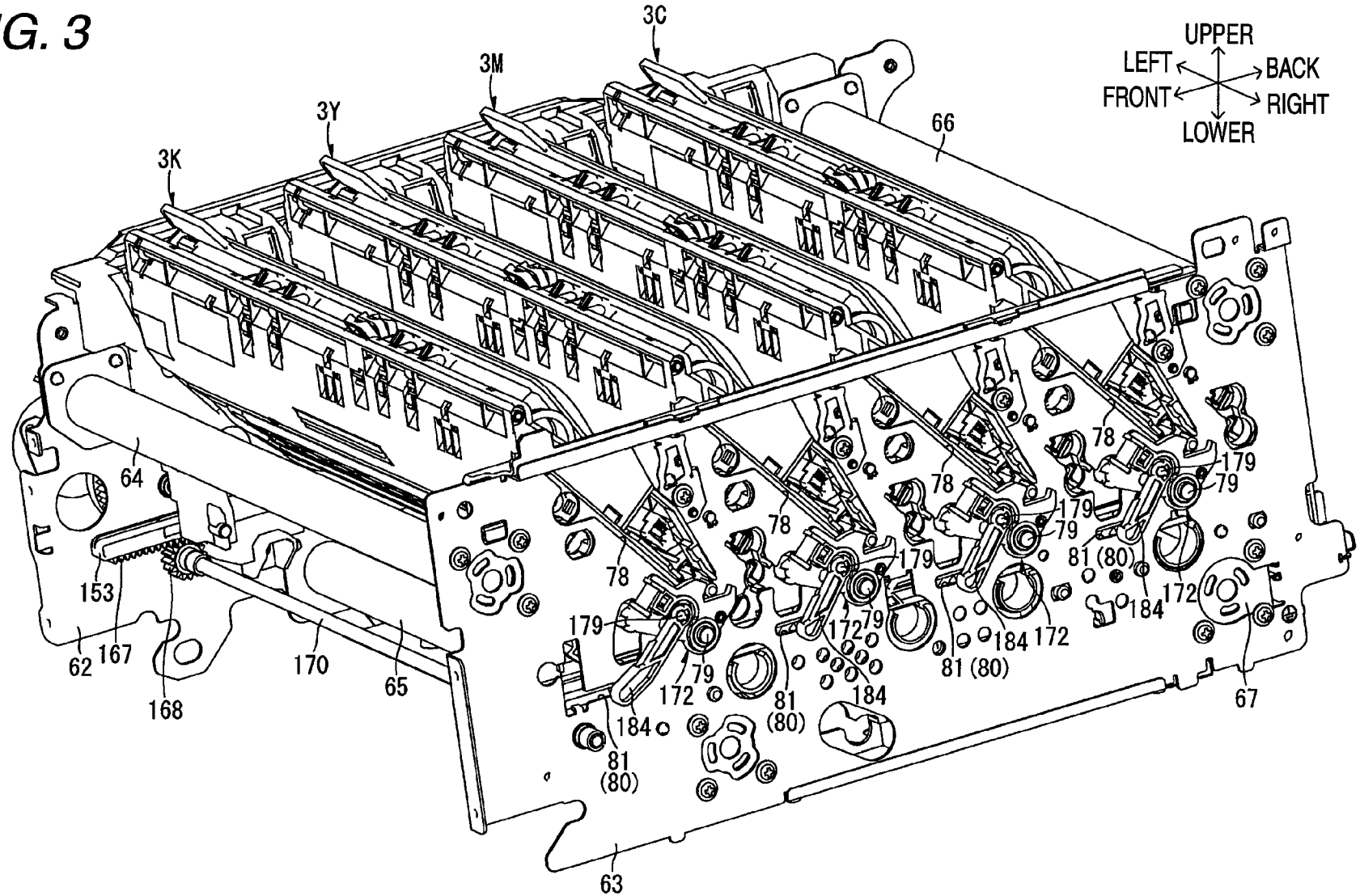
FIG. 3 is a perspective view of an interior of a main casing as viewed from the front right direction.

FIG. 3 is a perspective view showing an interior of the main casing 2 as viewed from the front right direction.

A pair of body frames 62, 63 are disposed so as to confront each other at a predetermined interval provided therebetween in the transverse direction. The respective body frames 62, 63 are made of a sheet metal and have a substantially rectangular shape as viewed from the side. A black process cartridge 3K, a yellow process cartridge 3Y, a magenta process cartridge 3M and a cyan process cartridge 3C are mounted between the body frames 62, 63 so as to be aligned in that order from the front side.

The body frames 62, 63 are connected together by four round bar-shaped connecting members 64, 65, 66, 67. The connecting member 64 is provided so as to extend between respective upper end portions of the body frames 62, 63 in front of the black process cartridge 3K. The connecting member 65 is provided so as to extend between respective lower end portions of the body frames 62, 63 below the black process cartridge 3K. The connecting member 66 is provided so as to extend between the respective upper end portions of the body frames 62, 63 in front of the cyan process cartridge 3C. The connecting member 67 is provided so as to extend between the respective lower end portions of the body frames 62, 63 in front of the cyan process cartridge 3C. By this configuration, the body frames 62, 63 and the connecting members 64 to 67 configure a robust structure which becomes free from deformation when the process cartridges 3 are mounted and dismounted from the printer 1.

(1) Left-hand Body Frame

Figure 4:
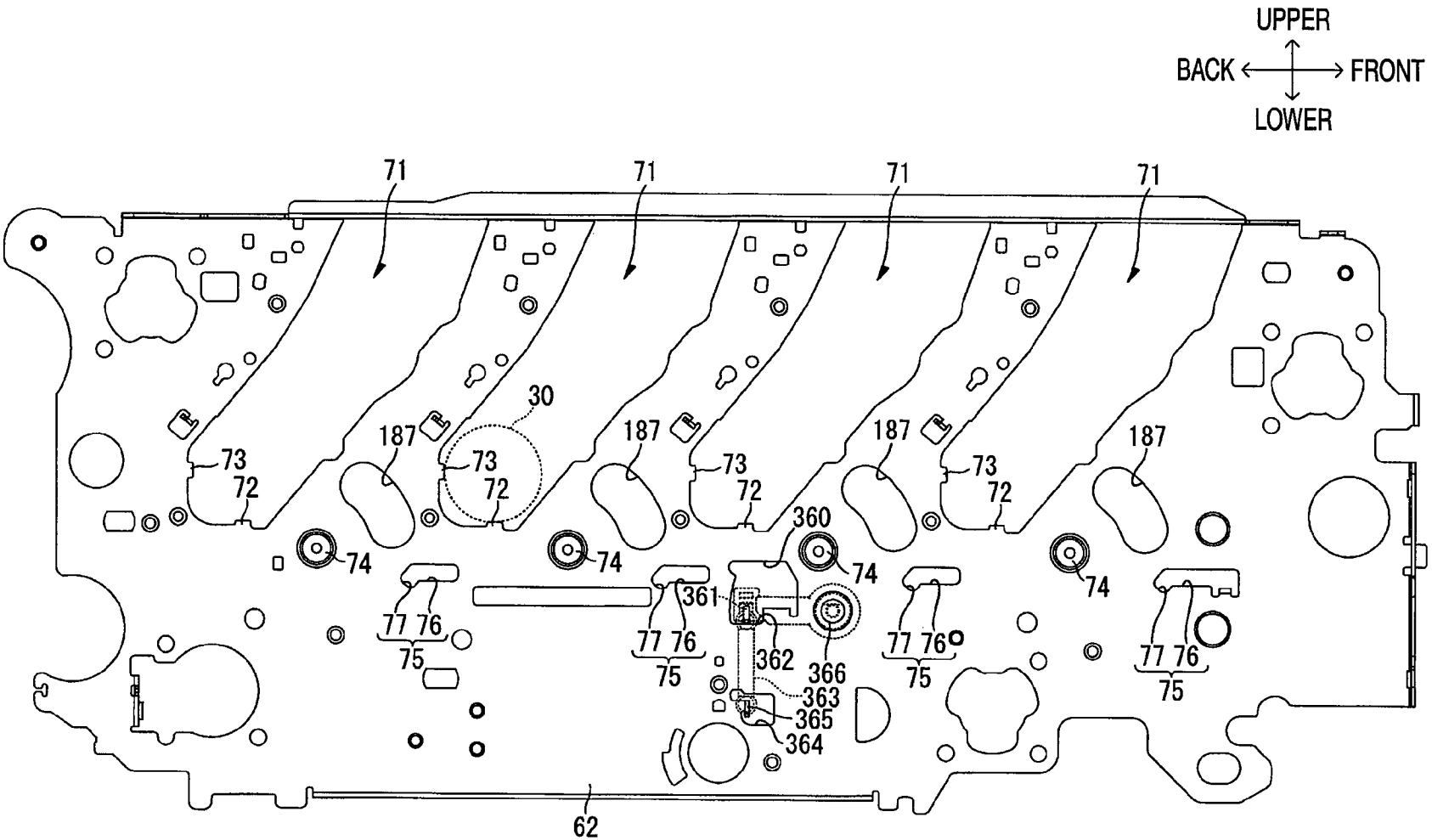
FIG. 4 is a side view of a left-hand body frame.

FIG. 4 is a left side view of the left-hand body frame.

Four process guide grooves 71 are formed in the left-hand body frame 62. Each process guide groove 71 is formed by cutting out the body frame 62 from an upper edge thereof, has a width corresponding to an outside diameter of the protecting portion 30 formed on the drum frame 21 and extends obliquely downwards from the upper edge to a vertically central portion of the body frame 62. A first abutment portion 72 having a rectangular shape as viewed from the side and projecting upwards in the process guide groove 71 and a second abutment portion 73 having a rectangular shape as viewed from the side and projecting forwards in the process guide groove 71 are formed at a lower end portion of each of the process guide grooves 71. The four process guide grooves 71 are formed at equal intervals in a front-back or longitudinal direction.

In addition, on the body frame 62, cylindrical projecting portions 74 which project leftwards are provided respectively in positions which lie spaced apart obliquely downwards towards the front from the lower end portions of the corresponding process guide grooves 71.

Further, on the body frame 62, guide holes 75 which penetrate through the body frame 62 are provided respectively in positions which lie spaced apart slightly obliquely downwards to the front relative to the corresponding projecting portions 74. Each guide hole 75 has a straight hole portion 76 which extends in the longitudinal direction and a intersecting hole portion 77 which extends obliquely downwards towards the rear from a rear end of the straight hole portion 76. In a front most guide hole 75 in the four guide holes 75, the straight hole portion 76 is formed longer than the straight hole portions 76 of the other guide holes 75.

In addition, on the body frame 62, a locking hole 360 is formed in such a manner as to penetrate through the body frame 62 between the second guide hole 75 and the third guide hole 75 from the front in a position which lies spaced apart from these guide holes 75. The locking hole 360 has a substantially quadrangular shape. A lower end of a back side portion of the locking hole 360 is formed in a position which is one step lower than a lower end of a front side portion thereof and extends flat in the longitudinal direction. The lower end of the back side portion of the locking hole 360 is, as is indicated by a broken line in FIG. 4, made to constitute a receiving portion 362 with which a locking portion 361, which will be described later, is brought into abutment.

Furthermore, on the body frame 62, a spring locking hole 364 is formed so as to penetrate through the body frame 62 below the locking hole 360. The spring locking hole 364 has a substantially quadrangular shape. A body side locking portion 365 is disposed within the spring locking hole 364, and the body side locking portion 365 has a shape in which it extends forwards from a rear end of the spring locking hole 364 and is bent leftwards from an intermediate portion along the length of the spring locking hole 364. As indicated by a broken line in FIG. 4, one end of a spring 363, which will be described later, is locked on the body side locking portion 365. The other end of the spring 363 is locked on the locking portion 361.

In addition, on the body frame 62, a cylindrical projecting portion 366 which projects rightwards is provided in a position which lies spaced apart to the front relative to the locking hole 360. In addition, on the body frame 62, arc-shaped holes 187 which are centered at the corresponding projecting portions 74 are formed so as to penetrate through the body frame 62 in positions which lie in front of the corresponding process guide grooves 71 and spaced apart obliquely upwards to the front from the corresponding projecting portions 74.

(2) Right-hand Body Frame

On the right-hand body frame 63, as shown in FIG. 3, four guide grooves 78 are formed respectively in positions which confront the four process guide grooves 71 formed in the left-hand body frame 62 in the transverse direction. The guide grooves 78 are formed by cutting partially the body frame 63 from an upper end thereof, extend obliquely downwards towards the rear from the upper end to a vertically central portion of the body frame 63 and are made to become narrower as they extend downwards.

In addition, on the body frame 63, cylindrical projecting portions 79 which project rightwards are provided respectively in positions which lie space apart obliquely downwards towards the front relative to lower end portions of the corresponding guide grooves 78.

Further, on the body frame 63, guide holes 80 which penetrate through the body frame 63 are formed respectively in positions which lie spaced apart slightly obliquely downwards towards the front relative the corresponding projecting portions 79. Each guide hole 80 has a straight hole portion 81 which extends in the longitudinal direction and an intersecting portion 82 (refer to FIG. 7) which extends obliquely downwards towards the rear from a rear end of the straight hole portion 81. In the front most guide hole 80 in the four guide holes 80, the straight hole portion 81 is formed longer than the straight hole portions 81 of the other guide holes 80.

5. Locking Mechanism

Figure 5:
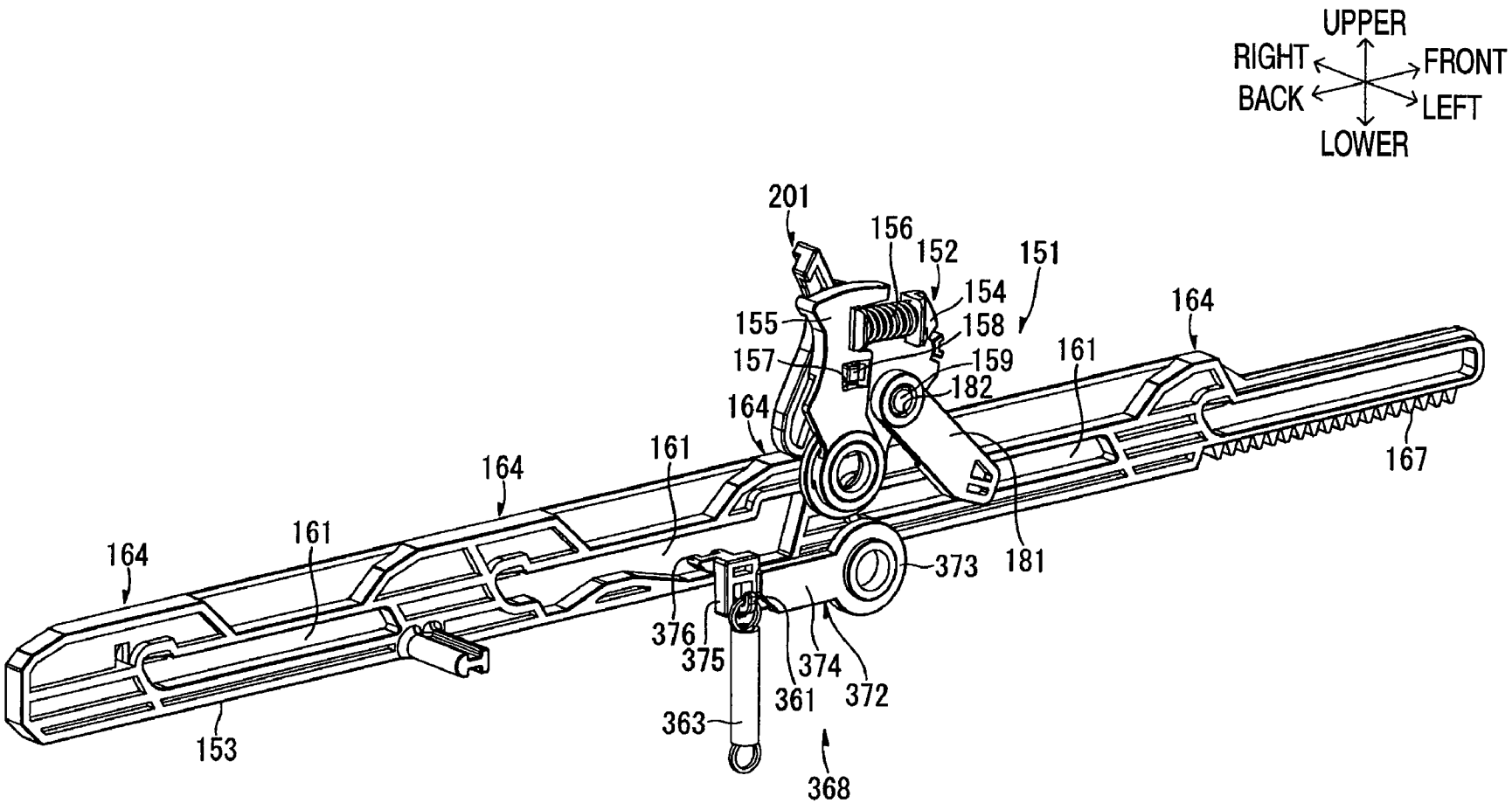
FIG. 5 is a perspective view of a locking mechanism, a spacing member and a force imparting mechanism as viewed from a rear left direction, which shows a state in which the spacing member is at a spacing posture.
Figure 6:
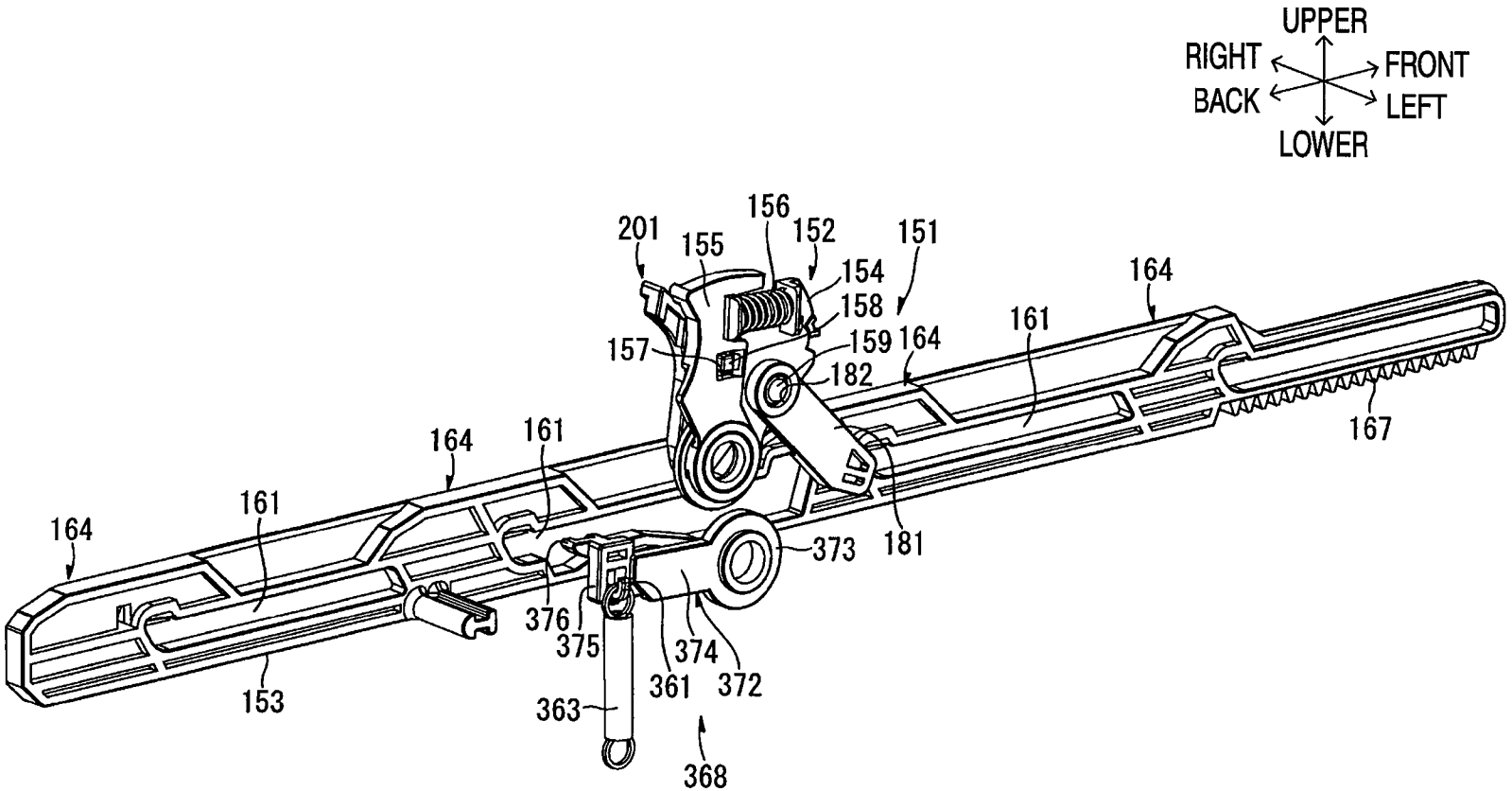
FIG. 6 is a perspective view of the locking mechanism, the spacing member and the force imparting mechanism as viewed from the rear left direction, which shows a state in which the spacing member is at a permitting posture.

FIG. 5 is a perspective view of a locking mechanism, a spacing member and a force imparting mechanism as viewed from a rear left direction, showing a state in which the spacing member is at a spacing posture. FIG. 6 is a perspective view of the locking mechanism, the spacing member and the force imparting mechanism as viewed from the rear left direction, showing a state in which the spacing member is at a permitting posture.

A locking mechanism 151 is provided on the printer 1 for fixing the respective process cartridges 3 to the body frames 62, 63 (refer to FIG. 3). The locking mechanism 151 includes four left-hand fixing members 152, four right-hand fixing members 172 (refer to FIG. 3) and a pair of left and right fixing/engagement and disengagement translation cams 153.

(1) Left-hand Fixing Members

The four left-hand fixing members 152 are disposed on a left-hand side of the left-hand body frame 62. In addition, the four left-hand fixing members 152 are provided so as to correspond, respectively, to the process cartridges 3 and are disposed in front of the protecting portions 30 (refer to FIG. 2), respectively, in such a state that the four process cartridges 3 are mounted within the main casing 2. Each left-hand fixing member 152 includes a lock lever 155, a pressing lever 154 and a coil spring 156.

The lock lever 155 is supported rotatably on the projecting portion 74 (refer to FIG. 4) which is formed on the left-hand body frame 63 at one end portion (a proximal end portion) thereof. A substantially rectangular hole 157 is formed at a central portion of the lock lever 155 in such a manner as to penetrate therethrough. A front edge of the other end portion (a distal end portion) of the lock lever 155 has a curved shape which corresponds to an external shape of the protecting portion 30 of the process cartridge 3.

The pressing lever 154 is disposed at a front side and on a right-hand side of the lock lever 155 and is supported rotatably on the projecting portion 74 (refer to FIG. 4) at one end portion (a proximal end portion) thereof. A hook portion 158 is formed at a central portion of the pressing lever 154, and the hook portion 158 projects forwards and is bent leftwards at a distal end portion thereof. The distal end portion of the hook portion 158 is inserted into the hole 157 in the lock lever 155 from the right. In addition, a connecting shaft 159 is formed at the central portion of the pressing lever 154 so as to project leftwards from a left-hand surface thereof. Furthermore, a support portion 160 (refer to FIG. 9) is formed at the central portion of the pressing lever 154 for supporting a spacing member 201, which will be described later. The support portion 160 projects rightwards from a right-hand surface of the pressing lever 154, passes through a hole 187 (refer to FIG. 4) in the body frame 62 and is situated on a right-hand side of the body frame 62 at a distal end thereof.

The coil spring 156 is interposed between the distal end portion of the lock lever 155 and the distal end portion of the pressing lever 154.

(2) Right-hand Fixing Members

Figure 7:
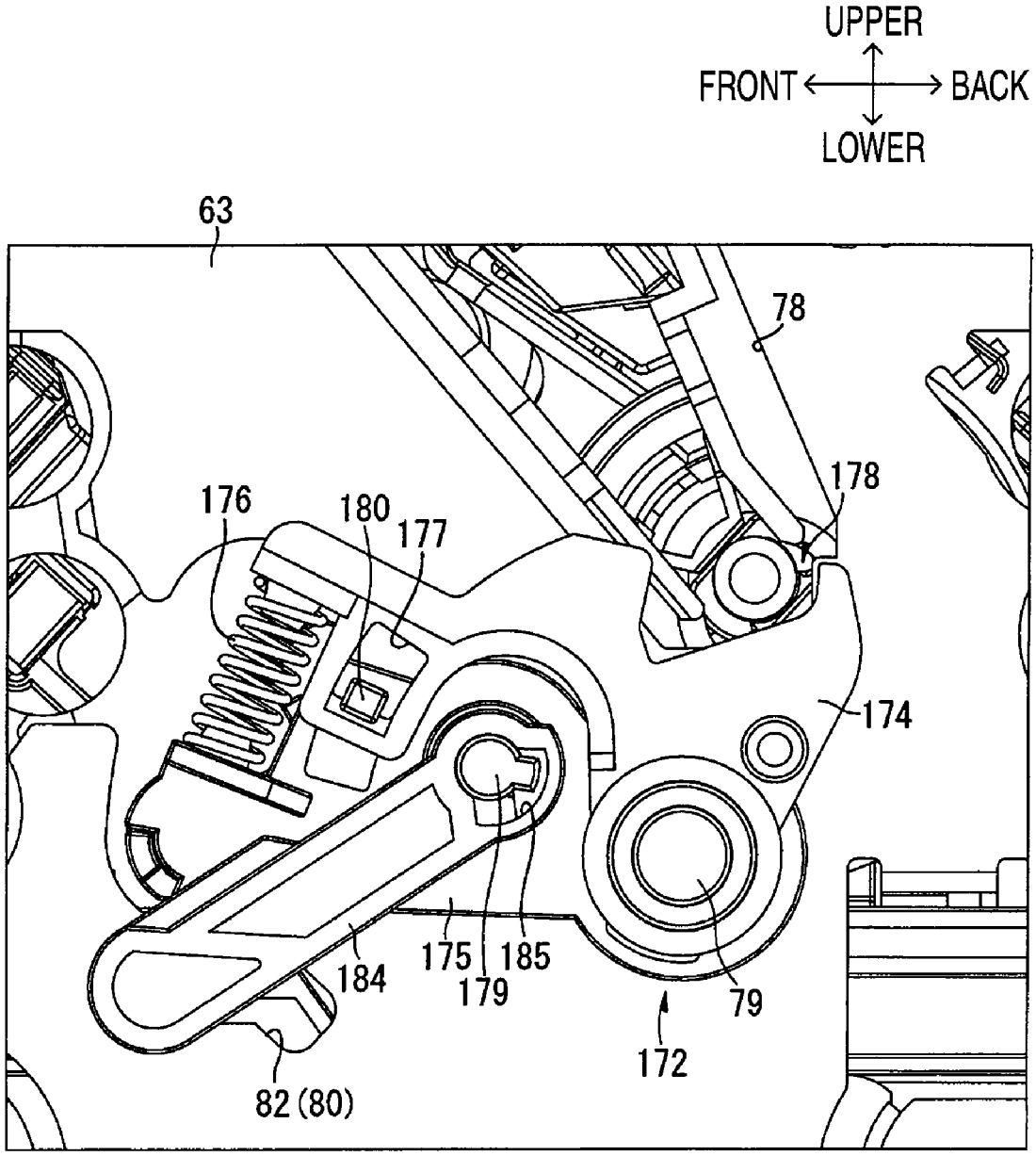
FIG. 7 is a right side view of part of a right-hand body frame.

FIG. 7 is a right side view of part of the right-hand side body frame.

The four right-hand fixing members 172 are provided so as to correspond respectively to the process cartridges 3 and are disposed on a right-hand side of the right-hand body frame 63. The right-hand fixing members 172 each include a lock lever 174, a pressing lever 175 and a coil spring 176.

The lock lever 174 has a substantially C-shape as viewed from the side. The lock lever 174 is supported rotatably on the projecting portion 79 which is formed on the right-hand body frame 63 at one end portion (a proximal end portion) thereof. A substantially rectangular hole 177 is formed at the other end portion (a distal end portion) of the lock lever 174 so as to penetrate therethrough. In addition, in the lock lever 174, a substantially concaved cut-out portion 178 is formed between the proximal end portion and the distal end portion so as to be recessed downwards.

The pressing lever 175 is disposed at a front side and on a left-hand side of the lock lever 174 and is supported rotatably on the projecting portion 79 at one end portion (a proximal end portion) thereof. A locking portion 180 is formed at the distal end portion of the pressing lever 175 so as to project rightwards. A distal end portion of the locking portion 180 is inserted in the hole 177 in the lock lever 174 from the left. In addition, a connecting shaft 179 is formed at a central portion of the pressing lever 175 so as to project rightwards. Furthermore, a support portion is formed at the central portion of the pressing lever 174 so as to project rightwards from a right-hand surface of the pressing lever 175, and the spacing member 201, which will be described later, is supported rotatably on this support portion.

The coil spring 176 is interposed between the distal end portion of the lock lever 174 and the distal end portion of the pressing lever 175.

(3) Fixing/Engagement and Disengagement Translation Cams

Figure 8:
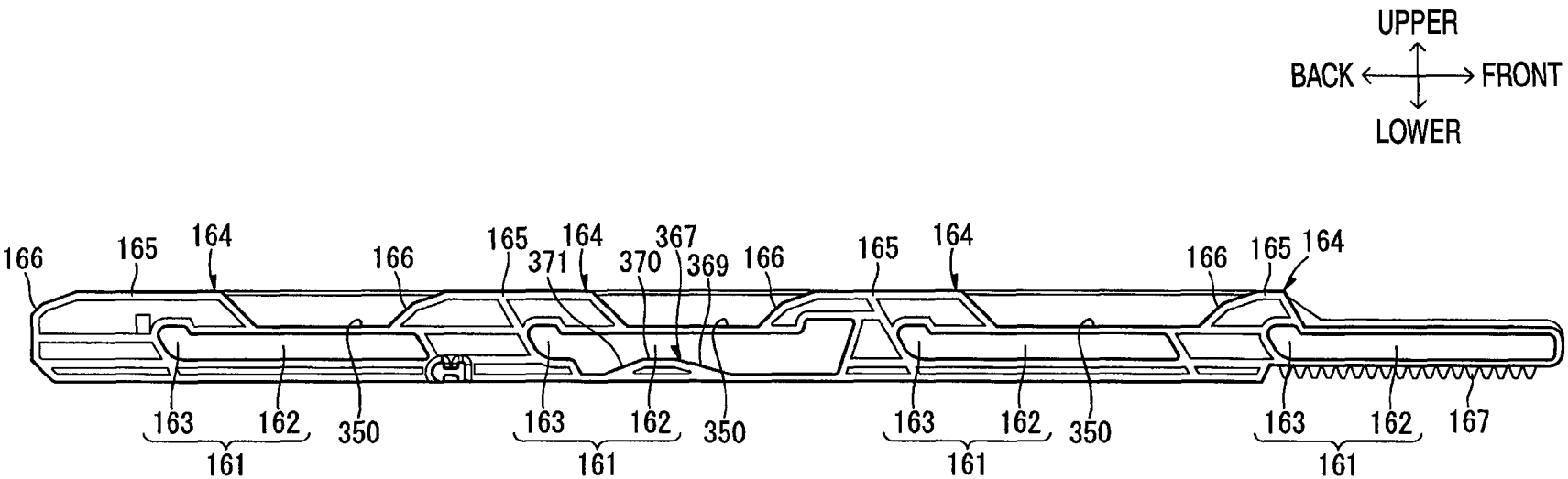
FIG. 8 is a left side view of a fixing/engagement and disengagement translation cam.

FIG. 8 is a left side view of the fixing/engagement and disengagement translation cam.

Since the left-hand and right-hand fixing/engagement and disengagement translation cams 153 have a transversely symmetrical configuration, in the following description, the left-hand fixing/engagement and disengagement translation cam 153 is used to describe the configuration thereof.

The fixing/engagement and disengagement translation cam 153 is a member which extends long in the longitudinal direction and is attached to an inner surface of the body frame 62 (refer to FIG. 3) so as to reciprocate in a straight line in the longitudinal direction.

Four guide grooves 161 are formed on a left-hand surface of the fixing/engagement and disengagement translation cam 153 so as to correspond respectively to the left-hand fixing members 152. The guide grooves 161 each have a straight groove portion 162 which extends long in the longitudinal direction and an intersecting groove portion 163 which extends over a short distance from a rear end of the straight groove portion 162 obliquely upwards towards the rear.

The third guide groove 161 from the front has a larger vertical width than those of the other guide grooves 161 and has an abutment portion 367 which has a substantially trapezoidal shape as viewed from the side and projects upwards from a lower surface thereof. Specifically, the abutment portion 367 has a front inclined surface 369 as an example of a first inclined surface which is inclined obliquely upwards to the rear from an intermediate portion of a bottom surface of the guide groove 161, a horizontal surface 370 which extends horizontally to the rear from a rear end of the front inclined surface 369, and a rear inclined surface 371 which is inclined downwards to the rear from a rear end of the horizontal surface 370.

Four cam portions 164 are formed on an upper surface of the fixing/engagement and disengagement translation cam 153 so as to be spaced apart from one another in the longitudinal direction. The four cam portions 164 are each formed to have a substantially trapezoidal shape as viewed from the side which projects upwards from the upper surface 350 (the permitting surface) of the fixing/engagement and disengagement translation cam 153 and each have a longitudinally extending horizontal surface 165 (a spacing surface) and an inclined surface 166 which continuously connects to a rear end of the horizontal surface 165 and the upper surface of the fixing/engagement and disengagement translation cam 153. A space between the frontmost cam portion 164 and the cam portion 164 which lies adjacent thereto is made longer than spaces which lie between the other cam portions which lie adjacent to one another.

A rack gear 167 is formed on a lower surface of a front end portion of the fixing/engagement and disengagement translation cam 153. As shown in FIG. 3, a pinion gear 168 is made to mesh with the rack gear 167 on the fixing/engagement and disengagement translation cam 153. Pinion gears 168 are attached to a left end portion and a right end portion of a connecting shaft 170 in such a manner as not to rotate on the connecting shaft 170. By this configuration, when the left-hand fixing/engagement and disengagement translation cam 153 moves in the longitudinal direction, the right-hand fixing/engagement and disengagement translation cam 153 moves in the same direction by the same moving amount in synchronism with the longitudinal movement of the left-hand fixing/engagement and disengagement translation cam 153.

(4) Link Members

The respective left-hand fixing members 152 and the left-hand fixing/engagement and disengagement translation cam 153 are connected to each other by link members 181 as is shown in FIGS. 5 and 6.

The connecting shaft 159 of the left-hand fixing member 152 is inserted into one end of the link member 181 in so as to rotate within a predetermined angular range. Specifically, a hole 182 is formed in one end portion of the link member 181. In addition, by the connecting shaft 159 being inserted in the hole 182, the link member 181 is allowed to rotate about the connecting shaft 159. On the other hand, a connecting shaft (not shown) is formed at the other end portion of the link member 181 in such a manner as to project rightwards. The connecting shaft is inserted into the guide hole 75 (refer to FIG. 4) in the body frame 62 and is fitted guide groove 161 at a distal end portion thereof.

The respective right-hand fixing members 172 and the right-hand fixing/engagement and disengagement translation cam 153 are connected to each other by link members 184 as shown in FIG. 3.

The connecting shaft 179 of the right-hand fixing member 172 is inserted into one end of the link member 184 so as to rotate within a predetermined angular range. Specifically, a substantially fan-shaped hole 185 is formed in the one end portion of the link member 184. The connecting shaft 179 has a key hole shape as viewed from the side having a projection on a circumferential surface thereof. In addition, by the connecting shaft 179 being inserted into the hole 185, the link member 184 is allowed to rotate about the connecting shaft 179 within a predetermined angular range. On the other hand, a connecting shaft (not shown) is formed at the other end portion of the link member 184 so as to project leftwards. The connecting shaft is inserted into the guide hole 80 in the body frame 63, and a distal end portion of the connecting shaft is fitted in the guide groove 161.

(5) Operation of Locking Mechanism (Left-hand Fixing Members and Right-hand Fixing Members)

The respective connecting shafts 159 of the left-hand link members 181 are inserted into the straight hole portions 76 (refer to FIG. 4) of the guide holes 75 in the body frame 62, and the distal end portions of the connecting shafts 179 are fitted in the intersecting groove portions 163 (refer to FIG. 8) of the guide grooves 161, respectively. In addition, the respective connecting shafts 179 of the right-hand link members 184 are inserted into the straight hole portions 81 (refer to FIG. 3) of the guide holes 80 in the body frame 63, and the distal end portions of the connecting shafts 179 are fitted in the intersecting groove portions 163 of the guide groves 163, respectively. In addition, the respective left-hand fixing members 152 are made to fall forwards in an inclined fashion so as to be withdrawn from mounting and dismounting paths of the process cartridges 3 and are situated in a position where they do not confront the process guide grooves 71 (refer to FIG. 4) in the transverse direction. As shown in FIG. 7, the respective right-hand fixing members 172 are each situated in a position where the cut-out portion 178 of the lock lever 174 confronts the lower end portion of the process guide groove 78 in the transverse direction and the bottom surface of the cut-out portion 178 intersects a direction which follows the process guide groove 78 substantially at right angles.

In this state, the process cartridges 3 can be mounted in and dismounted from the interior of the main casing 2. When mounting the process cartridge 3, with the projecting portion 30 (refer to FIG. 2) of the process cartridge 3 (the drum cartridge 7) fitted in the process guide grove 71 and the right end portion of the drum shaft of the photosensitive drum 5 fitted in the process guide groove 78, the process cartridge 3 is caused to move obliquely downwards towards the rear. By this action, the process cartridge 3 is mounted into the interior of the main casing 2 while the protecting portion 30 and the drum shaft are being guided by the process guide grooves 71, 78, respectively. In addition, when dismounting the process cartridge 3, while the protecting portion 30 and the drum shaft are being guided by the process guide grooves 71, 78, the process cartridge 3 is pulled up obliquely upwards to the front.

The distal end portions of the connecting shafts 159 of the respective left-hand link members 181 are fitted in the intersecting groove portions 163 of the guide grooves 161. Because of this, when the fixing/engagement and disengagement cam 153 is caused to move rearwards, the distal end portions of the connecting shafts 159 move rearwards in the straight hole portions 76 of the guide holes 75 in the body frame 62 while left fitted in the intersecting groove portions 163. By this action, the respective link members 181 rotate in such a manner as to be raised at the one end portions thereof, and in conjunction with the rotation of the link members 181, the respective left-hand fixing members 152 rotate to the rear about the projecting portions 74 (refer to FIG. 4) which are formed on the body frame 62. As a result, the respective left-hand fixing members 152 are put in a locked state and are disposed on the mounting and dismounting paths of the process cartridges 3, and front ends of the distal end portions of the lock levers 155 are brought into abutment with the protecting portions 30 of the process cartridges 3, whereby the protecting portions 30 are pressed obliquely downwards towards the rear.

On the other hand, the distal end portions of the connecting shafts 179 of the respective right-hand link members 184 are fitted in the intersecting groove portions 163 of the guide grooves 161. Because of this, when the fixing/engagement and disengagement translation cam 153 is caused to move rearwards, the distal end portions of the connecting shafts 179 move rearwards in the straight hole portions 81 of the guide grooves 80 in the body frame 63 with the distal end portions left fitted in the intersecting groove portions 163. By this action, the respective link members 184 rotate in such a manner as to be raised at the one end portions thereof, and in conjunction with the rotation of the link members 184, the respective right-hand fixing members 172 rotate to the rear about the projecting portions 79 which are formed on the body frame 63. As a result, the respective right-hand fixing members 72 are put in a locked state, and front end portions of the cut-out portions 178 of the lock levers 174 are brought into abutment with the drum shafts, whereby the drum shafts are pressed obliquely downwards towards the rear. By this action, the photosensitive drums 5 are fixed at both the left-hand and right-hand sides thereof.

6. Spacing Members

Figure 9:
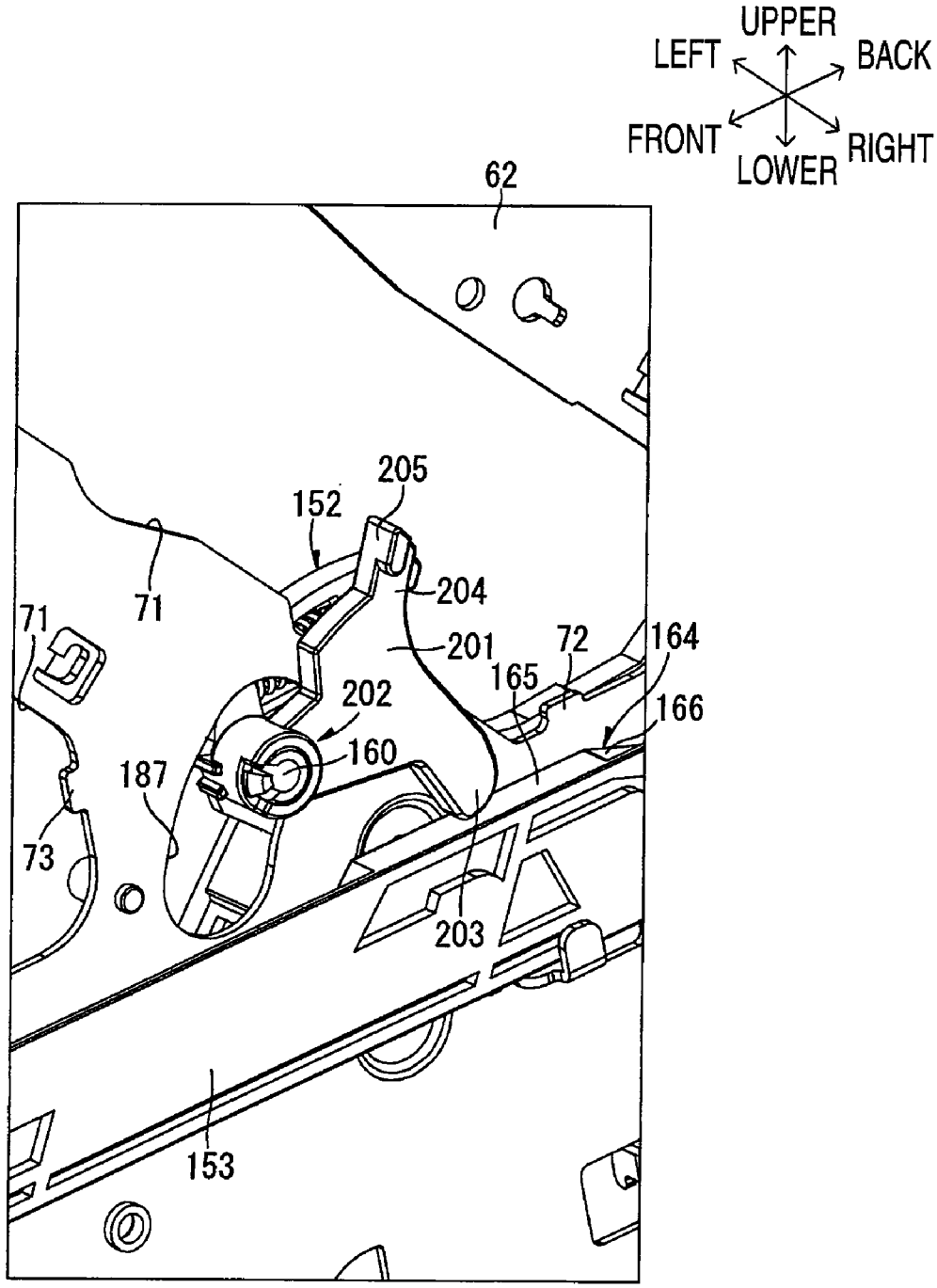
FIG. 9 is a right side view of part of the left-hand body frame, which shows a state in which the spacing member is at the spacing posture.
Figure 10:
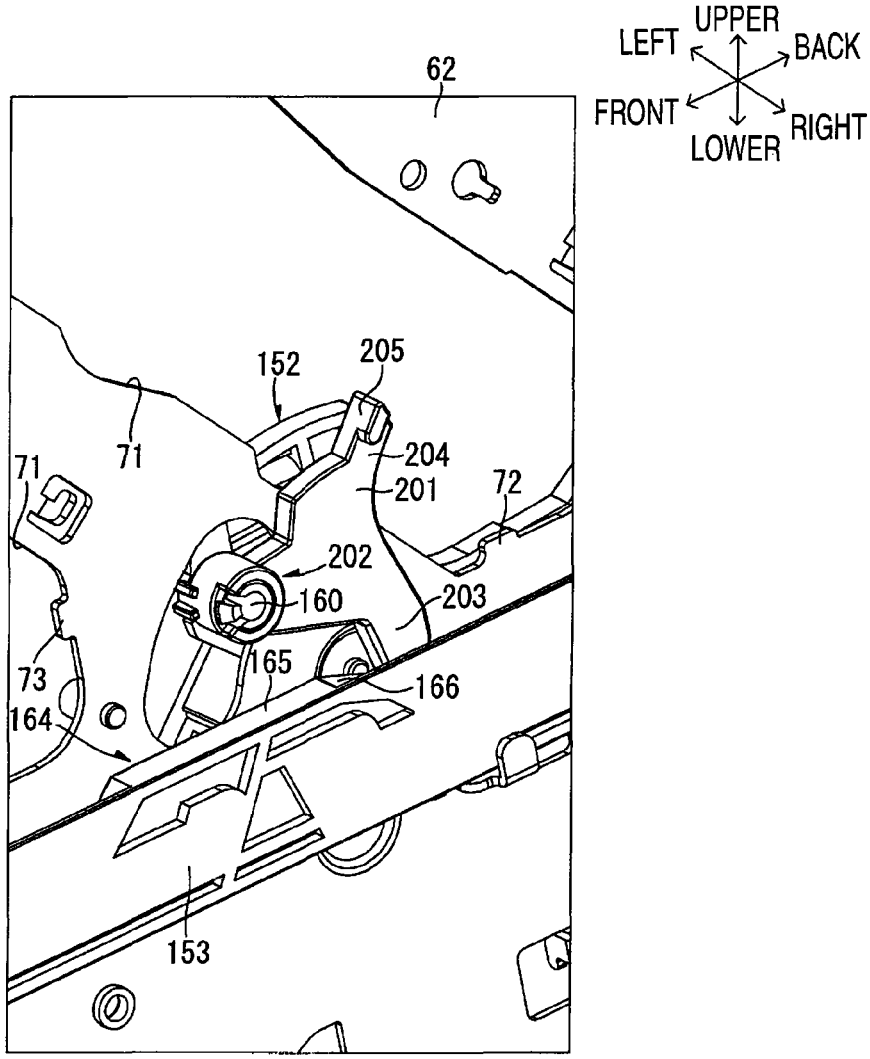
FIG. 10 is a right side view of the part of the left-hand body frame, which shows a state in which the spacing member is at the permitting posture.

FIG. 9 is a right side view of part of the left-hand body frame, which shows a state in which the spacing member is at a spacing posture. FIG. 10 is a right side view of the part of the left-hand body frame, which shows a state in which the spacing member is at a permitting posture.

A total of eight spacing members 201 are provided on the printer 1 so as to correspond respectively to individual fixing members of the four pairs of left and right fixing members 152. Since the spacing member provided correspondingly to the left-hand fixing member 152 and the spacing member 201 provided correspondingly to the right-hand fixing member 152 have configurations which are transversely symmetrical with each other, in the following description, the left-hand spacing member 201 is used to describe the configuration of the spacing member 201.

The four spacing members 201 are disposed on an inside (a right-hand side) of the left-hand body frame 62 so as to confront the corresponding fixing members 152 in the transverse direction.

The spacing member 201 has a substantially triangular shape. The support portion 160 which is provided on the pressing lever 154 is inserted relatively rotatably in a corner portion 202 of the spacing member 201, whereby the spacing member 201 is supported rotatably on the support portion 160.

The spacing member 201 is provided so as to extend rearwards from the support portion 160 and is disposed to rest on the upper surface of the fixing/engagement and disengagement translation cam 153. A lower projecting portion 203 is formed at a rear end portion of the spacing member 201 so as to project downwards. The lower projecting portion 203 is in abutment with the upper surface of the fixing/engagement and disengagement translation cam 153. In addition, an upper projecting portion 204 is provided at the rear end portion of the spacing member 201 in such a manner as to project upwards. A front surface of the upper projecting portion 204 is made to constitute a pressing surface 205.

7. Force Imparting Mechanisms

As shown in FIGS. 5 and 6, in relation to the left-hand fixing/engagement and disengagement translation cam 153, a force imparting mechanism 368 is provided for imparting a force including a rearward force component to the fixing/engagement and disengagement translation cam 153 in the midst of a forward movement of the fixing/engagement and disengagement translation cam 153.

The force imparting mechanism 368 is provided on a left-hand part of the fixing/engagement and disengagement translation cam 153. The force imparting mechanism 368 includes an abutment member 372 and a spring 363 for pressing a distal end portion (a rear end portion) of the abutment member 372 downwards.

Figure 11:
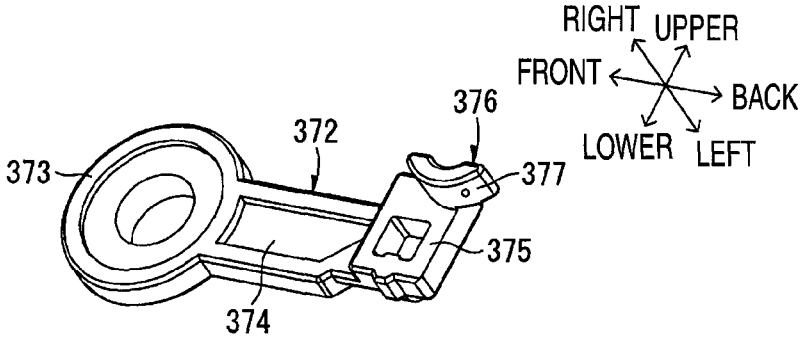
FIG. 11 is a perspective view of an abutment member as viewed from a rear right bottom direction.

FIG. 11 is a perspective view of the abutment member as viewed from a rear right bottom direction.

The abutment member 372 includes integrally a substantially annular plate-shaped support portion 373, a substantially rectangular extending portion 374 which extends from a circumferential surface of the support portion 373 and an acting portion 375 which is provided at a distal end portion of the extending portion 374. By the projecting portion 366 (refer to FIG. 4) of the body frame 62 being inserted relatively rotatably in the support portion 373, the abutment member 372 is supported on the projecting portion 366 so as to oscillate thereon.

The acting portion 375 has a substantially rectangular external shape as viewed from the side.

The locking portion 361, which extends leftwards and has a hook-like shape bent upwards, is formed on a left-hand surface of the acting portion 375. The other end of the spring 363, which is locked on the body side locking portion 365 (refer to FIG. 4) at the one end thereof, is locked on the locking portion 361. By this configuration, an elastic force is imparted to the acting portion 375 (the distal end portion of the abutment member 372) by the spring 363 so as to press the acting portion 375 downwards. The locking portion 361 enters the locking hole 360 (refer to FIG. 4) formed in the body frame 62 and is in abutment with the receiving portion 362 which is made up of the lower end of the rear portion of the locking hole 360 in such a state that the abutment member 372 and the fixing/engagement and disengagement translation cam 153 are not in abutment with each other.

An abutment portion 376, which extends rightwards and which is bent to the rear, is formed on a right-hand surface of the acting portion 375. A part of the abutment portion 376 which extends longitudinally enters the guide groove 161 (which is the third guide groove 161 from the front) and a lower surface thereof constitutes an arc-shaped abutment surface 377 which projects in a convexly curved fashion.

8. Engagement and Disengagement Driving Mechanism

Figure 12:
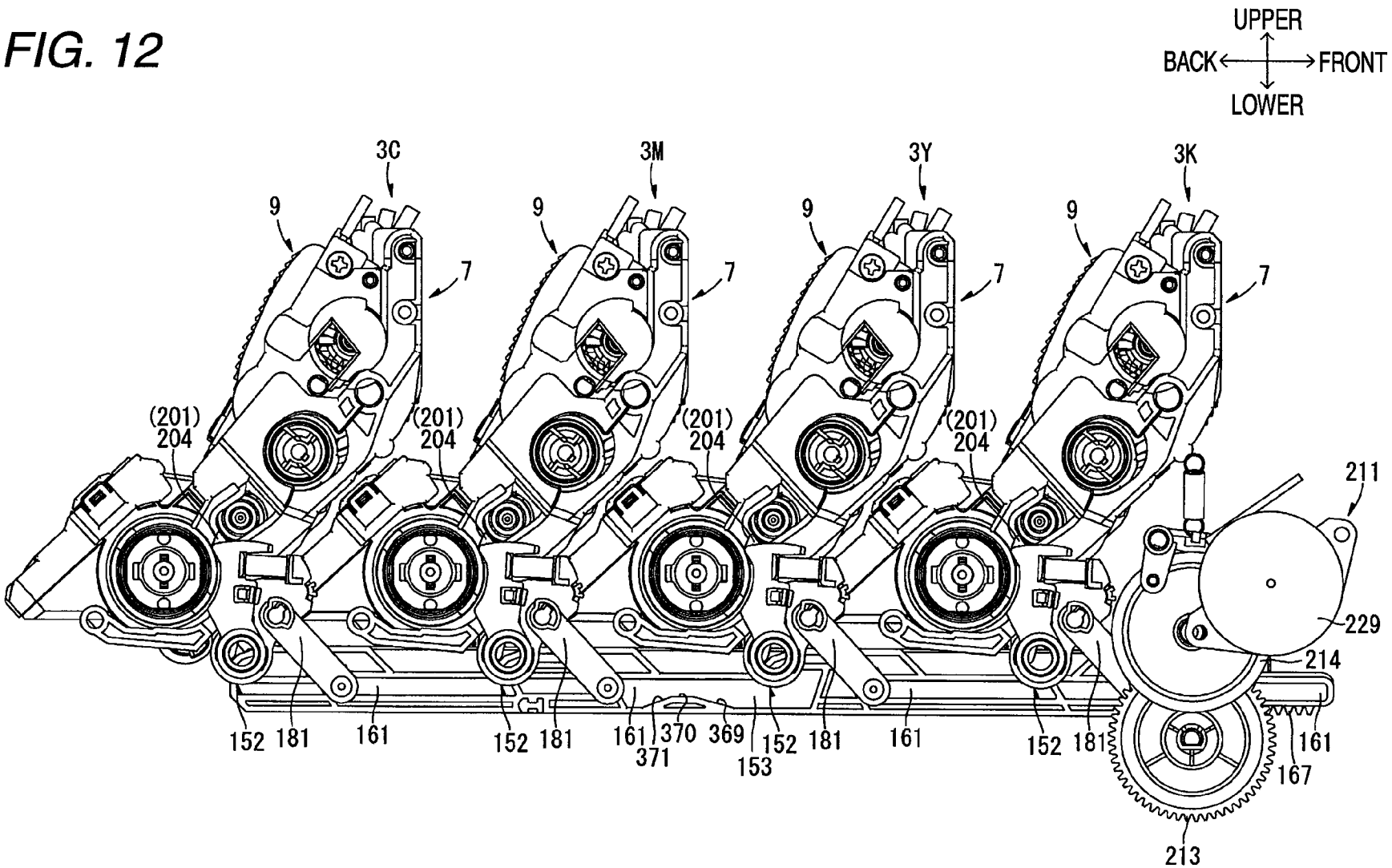
FIG. 12 is a left side view of a process cartridge, the lock mechanism and an engagement and disengagement driving mechanism, which shows a state in which all developing rollers are in engagement with corresponding photosensitive drums.
Figure 13:
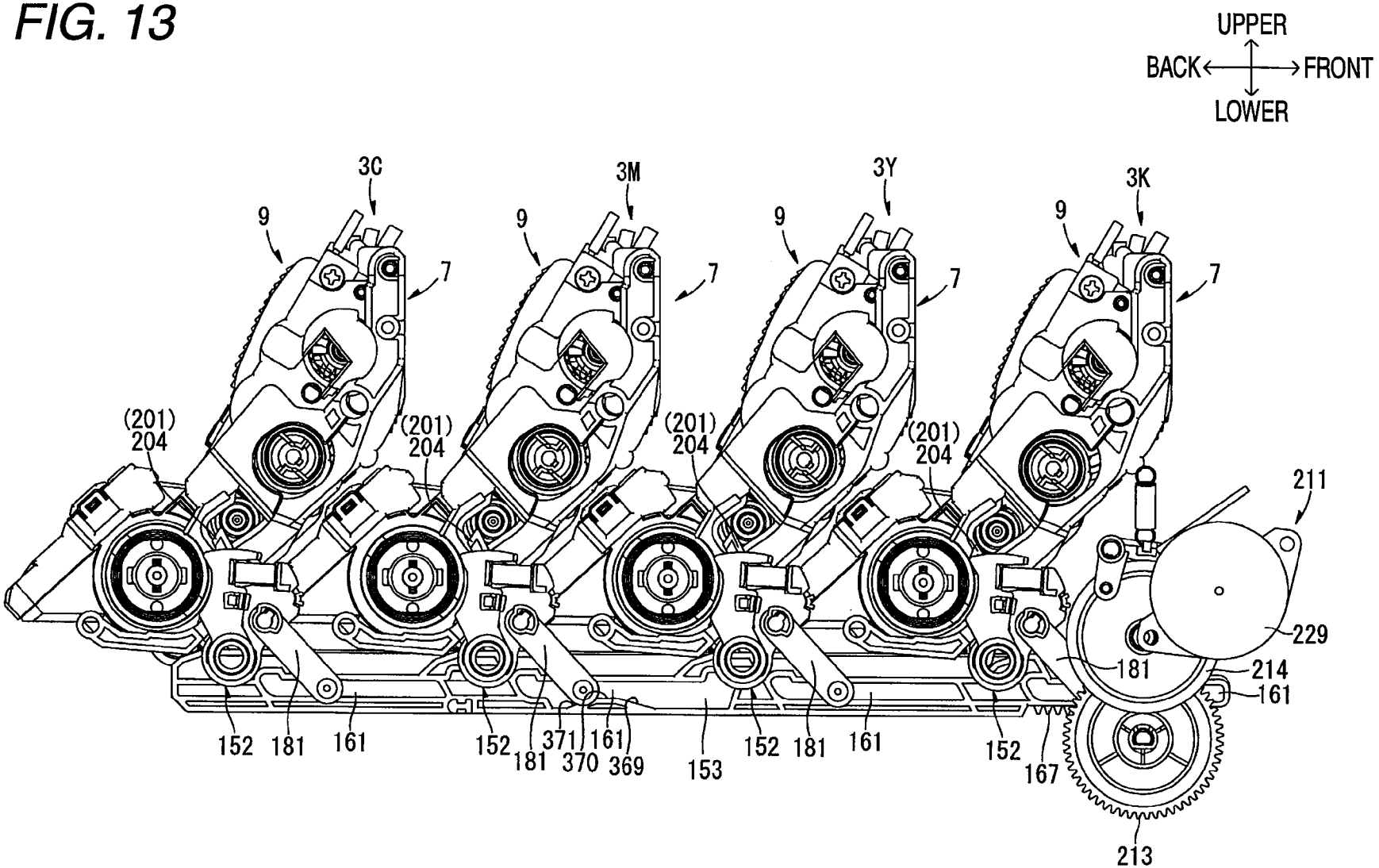
FIG. 13 is a left side view of the process cartridge, the lock mechanism and the engagement and disengagement driving mechanism, which shows a state in which the yellow, magenta and cyan developing rollers are disengaged from the corresponding photosensitive drums.
Figure 14:
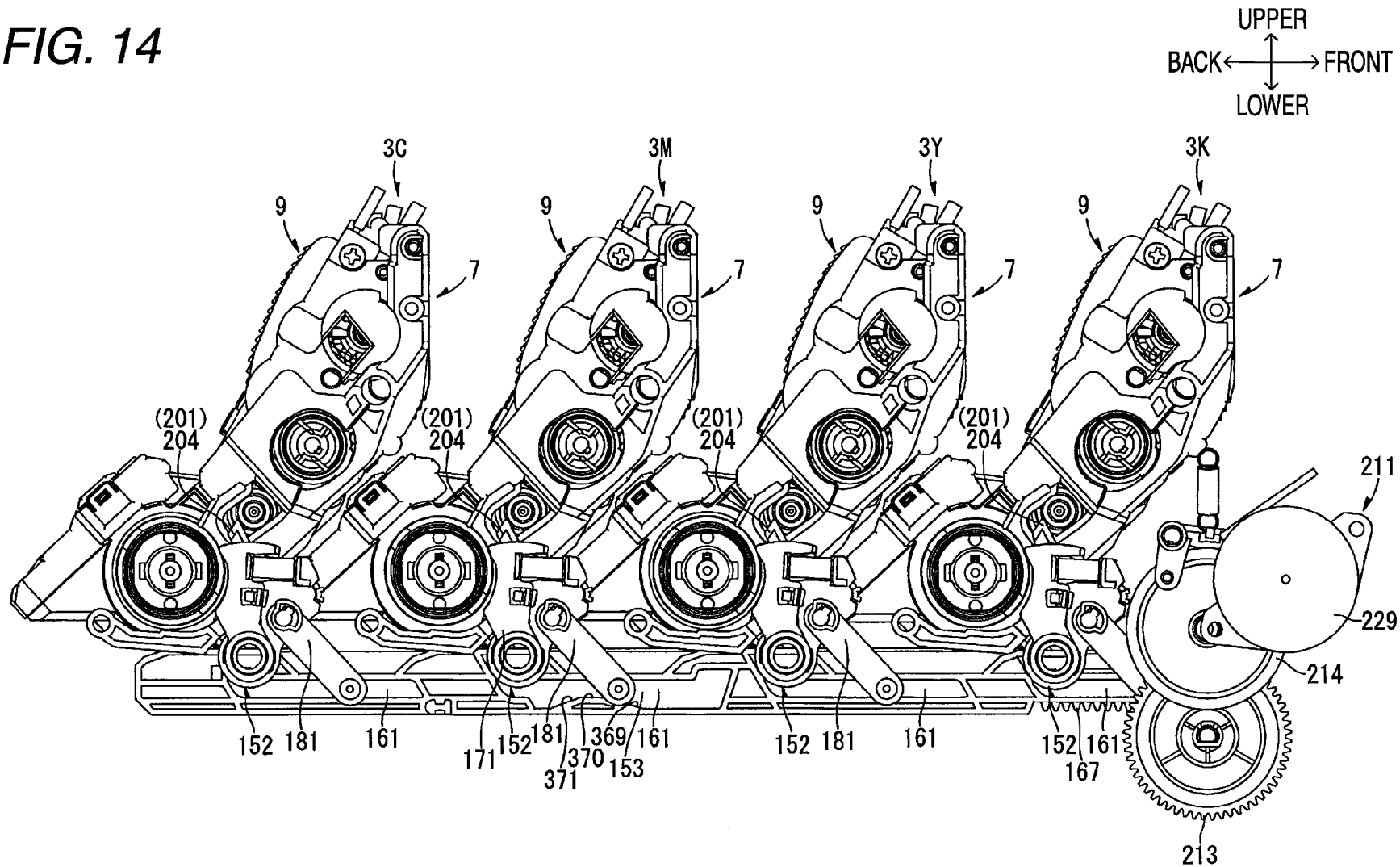
FIG. 14 is a left side view of the process cartridge, the lock mechanism and the engagement and disengagement driving mechanism, which shows a state in which all the developing rollers are disengaged from the corresponding photosensitive drums.

FIGS. 12 to 14 are left side views of the process cartridges, the locking mechanism, and an engagement and disengagement driving mechanism. FIG. 12 shows a state in which all the developing rollers are in engagement with the corresponding photosensitive drums, FIG. 13 shows a state in which the yellow, magenta and cyan developing rollers are disengaged or spaced apart from the corresponding photosensitive drums, and FIG. 14 shows a state in which all the developing rollers are disengaged or spaced apart from the corresponding photosensitive drums.

An engagement and disengagement driving mechanism 211 is provided on the printer 1 for reciprocating the fixing/engagement and disengagement translation cams 153 in the longitudinal direction.

The engagement and disengagement driving mechanism 211 includes an engagement and disengagement motor 229. Driving power generated by the engagement and disengagement motor 229 is made to be inputted into the pinion gear 168 via a clutch 214 and a gear 213. As has been described before, the pinion gear 168 is made to mesh with the rack gear 167. By this configuration, when the pinion gear 168 is caused to rotate forwards by the driving power of the engagement and disengagement motor 229, in conjunction with the forward rotation of the pinion gear 168, the fixing/engagement and disengagement translation cams 153 reciprocate in the longitudinal direction.

9. Engagement and Disengagement Actions of Developing Rollers Relative to Photosensitive Drums As is shown in FIG. 12, when the fixing/engagement and disengagement translation cam 153 is disposed in a frontmost position, all the spacing members 201 are at the permitting posture in which the lower projecting portions 203 are in abutment with the upper surfaces 350 (refer to FIG. 8) of the fixing/engagement and disengagement translation cam 153 (but are not in abutment with the cam portions 164) and the upper projecting portions 204 are lowered relatively downwards. Because of this, a state results in which the respective upper projecting portions 204 of the spacing members 201 are disengaged or spaced apart from the developing bearing members 58 which project leftwards and rightwards from the developing cartridges 9 and all the developing rollers 8 (refer to FIG. 1) are brought into engagement with the corresponding photosensitive drums 5 (refer to FIG. 1) (a state in which all the developing rollers 8 are disposed in their engagement positions).

When the fixing/engagement and disengagement translation cam 153 is caused to move rearwards from this state, the lower projecting portions 203 of the spacing members 201 which correspond respectively to the yellow process cartridge 3Y, the magenta process cartridge 3M and the cyan process cartridge 3C move from the upper surfaces 350 of the fixing/engagement and disengagement translation cam 153 onto the inclined surfaces 166 and move further from the inclined surfaces 166 onto the horizontal surfaces 165. By this series of actions, the spacing members 201 are made to take the spacing posture in which the lower projecting portions 203 are in abutment with the corresponding horizontal surfaces 165 and the upper projecting portions 204 are raised relatively upwards. As a result, as shown in FIG. 13, the pressing surfaces 205 of the upper projecting portions 204 push up the developing bearing members 58 of the yellow, magenta and cyan developing cartridges 9 from therebelow, whereby the yellow, magenta and cyan developing cartridges 9 are raised upwards, and the developing rollers 8 provided in the developing cartridges 9 are spaced apart from the corresponding photosensitive drums 5. As this occurs, the developing roller 8 provided in the black developing cartridge 9 remains in engagement with the corresponding photosensitive drum 5.

When the fixing/engagement and disengagement translation cam 153 is caused to move rearwards further from this state, the lower projecting portion 203 of the spacing member 201 which corresponds to the black process cartridge 3K moves from the upper surfaces 350 of the fixing/engagement and disengagement translation cam 153 onto the inclined surface 166, moves on the inclined surface 166 further and moves from the inclined surface 166 onto the horizontal surface 165. By this series of actions, the spacing member 201 is made to take a spacing posture in which the lower projecting portion 203 is brought into abutment with the horizontal surface 165 and the upper projecting portion 204 is raided relatively upwards. As a result, as is shown in FIG. 14, the pressing surface 205 of the upper spacing portion 204 comes to press against the developing bearing member 58 of the black developing cartridge 9 from therebelow so as to raise the black developing cartridge 9, whereby all the developing rollers 8 are spaced apart from the corresponding photosensitive drums 5.

On the other hand, when the fixing/engagement and disengagement translation cam 153 is caused to move forwards from the state in which all the developing rollers 8 are spaced apart from the corresponding developing rollers 8 (the state in which the all the developing rollers 8 are disposed in their disengagement positions), the lower projecting portion 203 of the spacing member 201 which corresponds to the black process cartridge 3 moves from the horizontal surface 165 onto the inclined surface 166, moves on the inclined surface 166 further and moves from the inclined surface 166 onto the upper surface 350 of the fixing/engagement and disengagement translation cam 153. By this series of actions, the spacing member 201 is made to take the permitting posture in which the lower projecting portion 203 is brought into abutment with the upper surface 350 and the upper projecting portion 204 is lowered relatively downwards. As a result, as is shown in FIG. 13, only the developing roller 8 provided in the black developing cartridge 9 is allowed to return to the state in which the developing roller 8 is in engagement with the corresponding photosensitive drum 5.

When the fixing/engagement and disengagement translation cam 153 is caused to move forwards further from this state, the lower projecting portions 203 of the spacing members 201 which correspond respectively to the yellow process cartridge 3Y, the magenta process cartridge 3M and the cyan process cartridge 3C altogether move from the horizontal surfaces 165 to the inclined surfaces 166, move on the inclined surfaces 166 further and move from the inclined surfaces 166 onto the upper surfaces 350 of the fixing/engagement and disengagement translation cam 153. By this series of actions, the spacing members 201 take the permitting postures in which the lower projecting portions 203 are brought into abutment with the upper surfaces 350 and the upper projecting portions 204 are lowered relatively downwards. As a result, as is shown in FIG. 12, all the developing rollers 8 are allowed to return to the state in which the developing rollers 8 are in engagement with the corresponding photosensitive drums 5.

When the lower projecting portions 203 of the three spacing members 201 move altogether from the horizontal surfaces 165 onto the inclined surfaces 166 in the midst of the series of actions, the three spacing members 201 apply a force to the corresponding inclined surfaces 166 almost simultaneously in such a way that the force acts vertically on the inclined surfaces 166. This force includes a forward force component. Because of this, when the developing rollers 8 of the yellow process cartridge 3Y, the magenta process cartridge 3M and the cyan process cartridge 3C are put in the state in which the developing rollers 8 are in engagement with the corresponding photosensitive drums 5, a forward force is applied to the fixing/engagement and disengagement translation cam 153 by virtue of the force applied to the inclined surfaces 166 from the spacing members 201.

Because of this, in the printer, as is shown in FIGS. 5 and 6, there is provided the force imparting mechanism 368. In the midst of movement of the developing rollers 8 of the yellow process cartridge 3Y, the magenta process cartridge 3M and the cyan process cartridge 3C from the disengagement position to the engagement position, the abutment surface 377 of the abutment member 372 is brought into abutment with the front inclined surface 369 of the abutment portion 367 which is formed on the fixing/engagement and disengagement translation cam 153. The distal end portion of the abutment member 372 is pressed in the downward direction which intersects the front inclined surface 369 by the spring 363. Because of this, when the abutment surface 377 is brought into abutment with the front inclined surface 369, a vertical force is applied to the front inclined surface 369 from the abutment surface 377. This force includes the rearward force component. Because of this, the forward force component which is included in the force applied to the inclined surface 166 from the spacing member 201 is cancelled by the rearward force component which is included in the force applied to the front inclined surface 369 from the abutment surface 377. By this action, when the three developing rollers 8 are caused to move altogether from the disengagement position to the engagement position, the pressing of forward movement of the fixing/engagement and disengagement translation cam 153 is prevented.

10. Advantages

Thus, the four photosensitive drums 5 are disposed in parallel in the interior of the main casing 2. In addition, the four developing rollers 8 are provided in the interior of the main casing 2 in such a manner as to correspond respectively to the photosensitive drums 5. Electrostatic latent images are formed on the photosensitive drums 5, and the latent images are developed by the developing rollers 8. Furthermore, the fixing/engagement and disengagement translation cams 153 are provided in the interior of the main casing 2 in such a manner as to reciprocate in a straight line in the direction in which the photosensitive drums 5 are aligned. The developing rollers 8 are caused to move between the engagement position where the developing rollers 8 are brought into engagement with the corresponding photosensitive drums 5 and the disengagement position where the developing rollers 8 are brought into disengagement from the corresponding photosensitive drums 5 by the fixing/engagement and disengagement translation cams 153 being caused to reciprocate in a straight line. When the fixing/engagement and disengagement translation cams 153 are caused to move forwards and at least one of the developing rollers 8 is caused to move from the disengagement position to the engagement position, in the midst of these operations, the abutment members 372 of the force imparting mechanisms 368 are brought into abutment with the corresponding fixing/engagement and disengagement translation cams 153, whereby the force including the rearward force component is imparted to the fixing/engagement and disengagement translation cams 153 by the corresponding force imparting mechanisms 368. Because of this, when the developing rollers are caused to move from the disengagement position to the engagement position through the forward movement of the fixing/engagement and disengagement translation cams 153, the pressing of forward movement of the fixing/engagement and disengagement translation cams 153 can be prevented.

The fixing/engagement and disengagement cam 153 has the front inclined surface 369 which is inclined forwards. The abutment member 372 of the force imparting mechanism 368 is brought into abutment with the front inclined surface 369 from the front in the midst of forward movement of the fixing/engagement and disengagement translation cam 153. The abutment member 372 is pressed downwards by the spring 363 which is included in the force imparting mechanism 368. Because of this, the force is imparted to the front inclined surface 369 from the abutment member 372 in such a manner as to act vertically on the front inclined surface 369. This force includes the rearward force component. Consequently, the pressing of forward movement of the fixing/engagement and disengagement translation cam 153 can be prevented in an ensured fashion by the simple configuration which is made up of the abutment member 372 and the spring 363.

The receiving portions 362 are provided on the body frames 62, 63 for receiving the forces from the abutment members 372. When all the developing rollers 8 are in the disengagement position, the abutment members 372 are in abutment with the receiving portions 362, whereby the receiving portions 362 can receive the forces from the abutment members 372. Consequently, when all the developing rollers 8 are in the disengagement positions, the fixing/engagement and disengagement translation cams 153 receive no force from the abutment members 372. Therefore, the disruption of the abutment members 372 to the forward movement of the fixing/engagement and disengagement translation cams 153 can be prevented during a period of time until the abutment members 372 are brought into abutment with the corresponding fixing/engagement and disengagement translation cams 153.

The four pairs of left and right spacing members 201 are provided in the interior of the main casing 2 so as to correspond respectively to the individual developing rollers 8. The spacing members 201 are displaced through the straight reciprocating motions of the fixing/engagement and disengagement translation cams 153 between the disengagement posture where the developing rollers 8 are held in the disengagement position and the permitting posture where the movement of the developing rollers 8 to the engagement position is permitted. In addition, the fixing/engagement and disengagement translation cam 153 has the plurality of horizontal surfaces 165 which are brought into engagement with the corresponding spacing members 201 when the spacing members 201 are at the spacing posture and the plurality of upper surfaces 350 which are brought into engagement with the corresponding spacing members 201 when the spacing members 201 are at the permitting posture. By causing the fixing/engagement and disengagement translation cam 153 to move from the state in which the horizontal surfaces 165 are in engagement with the corresponding spacing members 201 so as to bring the upper surfaces 350 into engagement with the spacing members 201, the spacing members 201 can be displaced from the spacing posture to the permitting posture. On the contrary to this, by causing the fixing/engagement and disengagement translation cam 153 to move from the state in which the upper surfaces 350 are in engagement with the corresponding spacing members 201 so as to bring the horizontal surfaces 165 into engagement with the spacing members 201, the spacing members 201 can be displaced from the permitting posture to the spacing posture.

In this way, the respective spacing members 201 can be caused to move between the disengagement position and the engagement position by the simple configuration in which the pluralities of horizontal surfaces 165 and the upper surfaces 350 are provided on the fixing/engagement and disengagement translation cam 153, whereby the engagement and disengagement of the developing rollers 8 with and from the corresponding photosensitive drums 5 can be attained.

The fixing/engagement and disengagement translation cam 153 has the inclined surfaces 166 which are inclined forwards and are adapted to connect the horizontal surfaces 165 and the upper surfaces 350 with which the respective spacing members 201 are brought into engagement. When at least one of the developing rollers 8 is caused to move from the disengagement position to the engagement position, the spacing member 201 which corresponds to the developing roller 8 in question is brought into engagement with the inclined surface 166, whereupon the abutment member 372 is brought into abutment with the front inclined surface 369.

When the spacing member 201 is brought into engagement with the inclined surface 166, the spacing member 201 applies the force to the inclined surface 166 such that the force acts vertically on the inclined surface 166. Since this force includes the forward force component, the forward force is made to act on the fixing/engagement and disengagement translation cam 153. On the other hand, by the abutment member 372 being brought into abutment with the front inclined surface 369, the abutment member 372 applies the force to the front inclined surface 369 in such a manner that the force acts vertically on the front inclined surface 369, whereby the rearward force is applied to the fixing/engagement and disengagement translation cam 153. Because of this, the pressing of forward movement of the fixing/engagement and disengagement translation cam 153 can be prevented at a good timing.

The plurality of spacing members 201 are provided in the interior of the main casing 2 so as to correspond respectively to the developing rollers 8. The spacing members 201 are displaced between the spacing posture in which the developing rollers 8 are held in the disengagement position and the permitting posture in which the developing rollers 8 are permitted to move to the engagement position through the straight reciprocating motions of the fixing/engagement and disengagement translation cams 153. By this configuration, by displacing the spacing members 201 to the spacing posture, the developing rollers 8 can be held in the disengagement position. In addition, by displacing the spacing members 201 to the permitting posture, the developing rollers can be held in the engagement position.

The developing rollers 8 are provided so as to correspond respectively to the colors of black, yellow, magenta and cyan. The force imparting mechanism 368 is brought into abutment with the fixing/engagement and disengagement translation cam 153 to thereby impart the fixing/engagement and disengagement translation cam 153 the force which includes the rearward force component when the three developing rollers 8 which correspond respectively to the colors of yellow, magenta and cyan are caused to move from the disengagement position to the engagement position. Because of this, when the three developing rollers 8 are caused to move from the disengagement position to the engagement position, the pressing of forward movement of the fixing/engagement and disengagement translation cams 153 can be prevented.

The rack gear 167 is formed on the fixing/engagement and disengagement cam 153. In addition, the printer 1 includes the pinion gear 168 which meshes with the rack gear 167. Because of this, by inputting a driving force into the pinion gear 168, the driving force so inputted can be transmitted to the fixing/engagement and disengagement translation cam 153 via the rack gear 167 so as to cause the fixing/engagement and disengagement translation cam 153 to reciprocate in a straight line. In addition, in a configuration like this, since a backlash exists between the pinion gear 168 and the rack gear 167, in the even that the forward movement of the fixing/engagement and disengagement translation cam 153 is pressed when the developing rollers 8 are caused to move from the disengagement position to the engagement position, there may be caused a fear that colliding noise is generated by collision between the pinion gear 168 and the rack gear 167. However, since the pressing of forward movement of the fixing/engagement and disengagement translation cam 153 can be prevented by the function of the force imparting mechanism 368, the generation of colliding noise that would be caused by the collision of the pinion gear 168 with the pinion gear 167 can be prevented.

11. Other Exemplary Embodiment

While the tandem type color printer is taken for description of the embodiment of the invention, the invention can be applied to an intermediate belt transfer type color printer in which toner images in the respective colors are transferred from the respective image carrier elements onto an intermediate transfer belt and thereafter, the color toner images so transferred are transferred onto a sheet of paper altogether.

With a view to achieving the object, according to a first aspect of the invention, there is provided an image forming apparatus including an apparatus main body, a plurality of image carrying members disposed in parallel in the apparatus main body, a plurality of developing members provided in such a manner as to correspond, respectively, to the image carrying members for developing latent images formed on the image carrying members, a translation member provided in the apparatus main body in such a manner as to reciprocate in a straight line in a direction in which the image carrying members are aligned and adapted to move the developing members to an engagement position where the developing members are brought into contact with the image carrying members and a disengagement position where the developing members are spaced apart from the image carrying members through its straight-line reciprocating actions, and a force imparting mechanism adapted to be brought into abutment with the translation member in motion when at least one of the developing members is moved from the disengagement position to the engagement position through movement of the translation member in a predetermined direction, so as to impart a force including a force component directed to an opposite direction to the predetermined direction to the translation member.

According to a second aspect of the invention, there is provided an image forming apparatus as set forth in the first aspect of the invention, wherein the translation member has first inclined surfaces which are inclined relative to the predetermined direction, and wherein the force imparting mechanism includes abutment members which are brought into abutment with the first inclined surfaces from a downstream side in the predetermined direction and springs for biasing the abutment members in a direction which intersects the first inclined surfaces.

According to a third aspect of the invention, there is provided an image forming apparatus as set forth in the second embodiment of the invention, including receiving members provided on the apparatus main body for receiving a force from the abutment members by the abutment members being brought into abutment therewith when all the developing members stay in the disengagement position.

According to a fourth aspect of the invention, there is provided an image forming apparatus as set forth in the second or third aspect of the invention, including a plurality of spacing members provided in such a manner as to correspond respectively to the developing members and adapted to be displaced to a spacing posture where the spacing members hold the developing members in the disengagement position and a permitting posture where the spacing members permit the movement of the developing members to the engagement position by the translation member reciprocating in the straight line, and wherein the translation member has a plurality of spacing surfaces adapted to be brought into contact with the spacing members when the spacing members are at the spacing posture and a plurality of permitting surfaces adapted to be brought into contact with the spacing members when the spacing members are as the permitting posture.

According to a fifth aspect of the invention, there is provided an image forming apparatus as set forth in the fourth aspect of the invention, wherein the translation member has second inclined surfaces which connect respectively the spacing surfaces and the permitting surfaces with which the spacing members are brought into contact and which are inclined relative to the predetermined direction, and wherein when at least one of the developing members is moved from the disengagement position to the engagement position, in the event that the spacing member corresponding to the developing member moved is brought into contact with the second inclined surface, the abutment member is brought into abutment with the first inclined surface.

According to a sixth aspect of the invention, there is provided an image forming apparatus as set forth in any of the first to third aspects of the invention, including a plurality of spacing members provided in such a manner as to correspond respectively to the developing members and adapted to be displaced to a spacing posture where the spacing members hold the developing members in the disengagement position and a permitting posture where the spacing members permit the movement of the developing members to the engagement position by the translation member reciprocating in the straight line.

According to a seventh aspect of the invention, there is provided an image forming apparatus as set forth in any of the first to sixth aspects of the invention, wherein the developing members are provided in such a manner as to correspond to respective colors of black, yellow, magenta and cyan, and wherein the force imparting mechanism is brought into abutment with the translation member in motion when three of the developing members which correspond to the respective colors of yellow, magenta and cyan are moved from the disengagement position to the engagement position, so as to impart a force including an opposite force component to the predetermined direction to the translation member.

According to an eighth aspect of the invention, there is provided an image forming apparatus as set forth in any of the first to seventh aspects of the invention, including a rack gear formed on the translation member, and a pinion gear adapted to mesh with the rack gear.

According to the first aspect of the invention, the plurality of image carrying members disposed in parallel in the apparatus main body. In addition, the plurality of developing members are provided in the apparatus main body in such a manner as to correspond, respectively, to the image carrying members. Latent images are formed on the image carrying members, and the latent images so formed are developed by the developing members. Furthermore, the translation member is provided in the apparatus main body in such a manner as to reciprocate in the straight line in the direction in which the image carrying members are aligned. By the translation member being caused to reciprocate in the straight line, the developing members are caused to move to the engagement position where the developing members are brought into contact with the image carrying members and the disengagement position where the developing members are disengaged or spaced apart from the image carrying members. Then, when the translation member is moved in the predetermined direction and at least one of the developing members is moved from the disengagement position to the engagement position, the force imparting mechanism is brought into abutment with the translation member in motion, whereby the force including the force component directed to the opposite direction to the predetermined direction is imparted to the translation member. Because of this, when the developing members are moved from the disengagement position to the engagement position through the movement of the translation member in the predetermined direction, the movement of the translation member in the predetermined direction can be prevented from being biased.

According to the second aspect of the invention, the translation member has the first inclined surfaces which are inclined relative to the predetermined direction. During the movement of the translation member in the predetermined direction, the abutment members included in the force imparting mechanism are brought into abutment with the first inclined surfaces from the downstream side in the predetermined direction. The abutment members are biased in the direction which intersects the first inclined surfaces by the springs included in the force imparting mechanism. Because of this, a force vertical to the first inclined surface is imparted to the first inclined surfaces by the abutment members. This force includes the opposite force component to the predetermined direction. Consequently, the biasing of the movement of the translation member in the predetermined direction can be prevented in an ensured fashion by the simple configuration made up of the abutment members and the springs.

According to the third aspect of the invention, the apparatus main body includes receiving members for receiving the force from the abutment members. When all the developing members stay in the disengagement position, the abutment members are brought into abutment with the receiving portions, and the receiving portions can receive the force from the abutment members. Consequently, when all the developing members stay in the disengagement position, the translation member receives no force from the abutment members. Therefore, the abutment members can be prevented from interrupting the movement of the translation member in the predetermined direction until the abutment members are brought into abutment with the translation member.

According to the fourth aspect of the invention, the plurality of spacing members are provided within the apparatus main body in such a manner as to correspond respectively to the developing members. The spacing members are displaced to the spacing posture where the spacing members hold the developing members in the disengagement position and the permitting posture where the spacing members permit the movement of the developing members to the engagement position by the translation member reciprocating in the straight line. In addition, the translation member has the plurality of spacing surfaces adapted to be brought into contact with the spacing members when the spacing members are at the spacing posture and the plurality of permitting surfaces adapted to be brought into contact with the spacing members when the spacing members are at the permitting posture. By moving the translation member from the state in which the spacing surfaces are in engagement with the spacing members so as to bring the permitting surfaces into contact with the spacing members, the spacing members can be displaced from the spacing posture to the permitting posture. On the contrary to this, by moving the translation member from the state in which the permitting surfaces are in engagement with the spacing members so as to bring the spacing surfaces into contact with the spacing members, the spacing members can be displaced from the permitting posture to the spacing posture.

In this way, by the simple configuration in which the plurality of spacing surfaces and the plurality of permitting surfaces are provided on the translation member, the respective spacing members can be moved between the disengagement position and the engagement position, whereby the engagement and disengagement of the developing rollers with and from the corresponding photosensitive drums can be attained.

According to the fifth aspect of the invention, the translation member has the second inclined surfaces which connect respectively the spacing surfaces and the permitting surfaces with which the spacing members are brought into contact and which are inclined relative to the predetermined direction. When at least one of the developing members is moved from the disengagement position to the engagement position, in the event that the spacing member corresponding to the developing member moved is brought into contact with the second inclined surface, the abutment member is brought into abutment with the first inclined surface.

When the spacing members come into contact with the second inclined surfaces, a force vertical to the second inclined surface is imparted to the second inclined surfaces from the spacing members. Since the force includes a force component directed in the predetermined direction, the force direction in the predetermined direction is applied to the translation member. On the other hand, by the abutment members being brought into abutment with the first inclined surfaces, the force directed in the direction vertical to the first inclined surface is imparted to the first inclined surfaces from the abutment members, whereby the force opposite to the predetermined direction is applied to the translation member. Because of this, the biasing of the movement of the translation member in the predetermined direction can be prevented at a good timing.

According to the sixth aspect of the invention, the plurality of spacing members are provided within the apparatus main body in such a manner as to correspond respectively to the developing members. The spacing members are displaced to the spacing posture where the spacing members hold the developing members in the disengagement position and the permitting posture where the spacing members permit the movement of the developing members to the engagement position by the translation member reciprocating in the straight line. By this configuration, by the spacing members being displaced to the spacing posture, the developing members can be held in the disengagement position. In addition, by the spacing members being displaced to the permitting posture, the developing members can be held in the permitting or engagement position.

According to the seventh aspect of the invention, the developing members are provided in such a manner as to correspond to the respective colors of black, yellow, magenta and cyan. The force imparting mechanism is brought into abutment with the translation member in motion when three of the developing members which correspond to the respective colors of yellow, magenta and cyan are moved from the disengagement position to the engagement position, so as to impart the force including the opposite force component to the predetermined direction to the translation member. Because of this, the movement of the translation member in the predetermined direction occurring when the three developing members are moved from the disengagement position to the engagement position can be prevented from being biased.

According to the eighth aspect of the invention, the rack gear is formed on the translation member. In addition, the image forming apparatus includes a pinion gear adapted to mesh with the rack gear. Because of this, by a driving force being inputted into the pinion gear, the driving force is transmitted to the translation member via the rack gear, thereby making it possible to cause the translation member to reciprocate in the straight line. In addition, in the configuration described above, since there exists a backlash between the pinion gear and the rack gear, when the developing members are moved from the disengagement position to the engagement position, in the event that the movement of the translation member in the predetermined direction is biased, there is caused a fear that a colliding noise may be generated as a result of the pinion gear being brought into collision with the rack gear. However, since the biasing of the movement of the translation member in the predetermined direction can be prevented by the action of the force imparting mechanism, the generation of such a colliding noise resulting from the collision of the pinion gear with the rack gear can be prevented.

What is claimed is:

1. An image forming apparatus comprising:

an apparatus main body;

a plurality of image carrying members disposed in parallel in the apparatus main body;

a plurality of developing members for developing latent images formed on the image carrying members, each developing member being associated with a respective image carrying member;

a translation member that reciprocates in a straight line in a direction in which the image carrying members are aligned to move the developing members between an engagement position where the developing members are brought into contact with the image carrying members and a disengagement position where the developing members are disengaged from the image carrying members; and a force imparting mechanism, when at least one of the developing members is moved from the disengagement position to the engagement position by a movement of the translation member in a first direction, the force imparting mechanism being brought into abutment with the translation member in motion, and imparting a force that includes a force component directed to a second direction opposite to the first direction.

2. The image forming apparatus according to claim 1, wherein the translation member has a first inclined surface that is inclined relative to the first direction, and wherein the force imparting mechanism includes:

an abutment member that is configured to be brought into abutment with the first inclined surface from a downstream side in the first direction; and a spring for pressing the abutment member in a direction which intersect the first inclined surface.

3. The image forming apparatus according to claim 2, further comprising, a receiving portion that is provided on the apparatus main body for receiving a force from the abutment member, the receiving portion being brought into abutment with the abutment member and receiving the force from the abutment member when all the developing members stay in the disengagement position.

4. The image forming apparatus according to claim 2, further comprising, a plurality of spacing members, each spacing member being associated with a respective developing member, and being movable between a spacing posture where the spacing member holds the developing member in the disengagement position and a permitting posture where the spacing member permits the movement of the developing member to the engagement position by the translation member reciprocating in the straight line, and wherein the translation member comprises;

a plurality of spacing surfaces, each spacing surface being configured to be brought into contact with a respective spacing member when the spacing member is at the spacing posture, and a plurality of permitting surfaces, each permitting surface being configured to be brought into contact with the respective spacing member when the spacing member is at the permitting posture.

5. The image forming apparatus according to claim 4, wherein the translation member comprises a plurality of second inclined surfaces, each second surface connecting a respective spacing surface and a respective permitting surface, and being inclined relative to the first direction, and wherein when at least one of the developing members is moved from the disengagement position to the engagement position, the spacing member that is associated with the moved developing member is brought into contact with the second inclined surface, and the abutment member is brought into abutment with the first inclined surface.

6. The image forming apparatus according to claim 1, further comprising, a plurality of spacing members, each spacing member being associated with a respective developing member, and being movable between a spacing posture where the spacing member holds the developing member in the disengagement position and a permitting posture where the spacing member permits the movement of the developing member to the engagement position by the translation member reciprocating in the straight line.

7. The image forming apparatus according to claim 1, wherein the developing members are provided so as to correspond to respective colors of black, yellow, magenta and cyan, and wherein when three of the developing members associated with the respective colors of yellow, magenta and cyan are moved from the disengagement position to the engagement position, the force imparting mechanism is brought into abutment with the translation member in motion, and imparts the force that includes the force component directed to the second direction opposite to the first direction.

8. The image forming apparatus according to claim 1, further comprising:

a rack gear formed on the translation member; and a pinion gear configured to mesh with the rack gear.

* * * * *